US009354553B2

(12) United States Patent
Yoshida et al.

(10) Patent No.: US 9,354,553 B2
(45) Date of Patent: May 31, 2016

(54) DEVELOPER ACCOMMODATING CONTAINER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Masatomi Yoshida, Kawasaki (JP); Masaki Furutani, Tokyo (JP); Masaaki Matsushita, Yokohama (JP); Tetsuo Uesugi, Yokohama (JP); Seiichi Shinohara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/151,925

(22) Filed: Jan. 10, 2014

(65) Prior Publication Data

US 2014/0199093 A1 Jul. 17, 2014

(30) Foreign Application Priority Data

Jan. 11, 2013 (JP) ..... 2013-003947
May 28, 2013 (JP) ..... 2013-112297

(51) Int. Cl.
*G03G 15/08* (2006.01)
*G03G 21/16* (2006.01)

(52) U.S. Cl.
CPC ..... *G03G 15/0882* (2013.01); *G03G 15/0841* (2013.01); *G03G 15/0868* (2013.01); *G03G 15/0874* (2013.01); *G03G 15/0898* (2013.01); *G03G 21/1676* (2013.01); *G03G 2215/0682* (2013.01); *G03G 2215/0687* (2013.01); *G03G 2215/0875* (2013.01)

(58) Field of Classification Search
CPC ..... G03G 15/0868; G03G 15/0841; G03G 15/0874; G03G 2215/0682; G03G 2215/0687; G03G 2215/0875; G03G 15/0898; G03G 15/0882; G03G 21/1676
USPC ..... 399/103, 106, 119, 120, 258
See application file for complete search history.

(56) References Cited

U.S. PATENT DOCUMENTS

| | | | | |
|---|---|---|---|---|
| 5,030,998 | A * | 7/1991 | Shibata et al. | 399/106 |
| 5,412,364 | A * | 5/1995 | Iguchi et al. | 399/262 |
| 6,169,869 | B1 | 1/2001 | Inami et al. | |
| 6,175,703 | B1 | 1/2001 | Nakazono et al. | |
| 6,317,574 | B1 | 11/2001 | Shinohara et al. | |
| 6,337,964 | B2 | 1/2002 | Inami et al. | |
| 6,539,190 | B2 | 3/2003 | Oba et al. | |
| 6,898,401 | B2 | 5/2005 | Okano et al. | |
| 6,963,706 | B2 | 11/2005 | Morioka et al. | |
| 6,978,100 | B2 | 12/2005 | Yasui et al. | |
| 7,155,137 | B2 | 12/2006 | Yasui et al. | |

(Continued)

FOREIGN PATENT DOCUMENTS

JP H 4-66980 3/1992

*Primary Examiner* — Ryan Walsh
(74) *Attorney, Agent, or Firm* — Fitzpatrick, Cella, Harper & Scinto

(57) ABSTRACT

A developer accommodating container for accommodating a developer includes: a flexible container provided with an opening for permitting discharge of the developer; a sealing member for sealing the opening in a state in which the sealing member is bonded to a periphery of the opening, wherein the sealing member is capable of exposing the opening by being removed by pulling; and a reinforcing portion, provided at least as a part of the periphery of the opening, for decreasing a degree of deformation of the opening.

28 Claims, 18 Drawing Sheets

(56) References Cited

U.S. PATENT DOCUMENTS

| | | | | |
|---|---|---|---|---|
| 7,398,040 | B2 | 7/2008 | Yoshida | |
| 2011/0064478 | A1* | 3/2011 | Yamaguchi et al. | 399/262 |
| 2011/0170906 | A1 | 7/2011 | Matsushita et al. | |
| 2012/0134710 | A1 | 5/2012 | Shinohara | |
| 2013/0136489 | A1 | 5/2013 | Yamaguchi et al. | |
| 2013/0164039 | A1 | 6/2013 | Matsushita et al. | |
| 2013/0164040 | A1 | 6/2013 | Matsushita et al. | |
| 2013/0336679 | A1 | 12/2013 | Furutani et al. | |
| 2013/0343785 | A1 | 12/2013 | Matsuzaki et al. | |
| 2014/0016961 | A1 | 1/2014 | Yasui et al. | |
| 2014/0029974 | A1 | 1/2014 | Uesugi et al. | |
| 2014/0064793 | A1 | 3/2014 | Matsuzaki et al. | |
| 2014/0072329 | A1 | 3/2014 | Uesugi et al. | |
| 2014/0072330 | A1 | 3/2014 | Yoshida et al. | |
| 2014/0072331 | A1 | 3/2014 | Matsushita et al. | |
| 2014/0072345 | A1 | 3/2014 | Matsunaga et al. | |
| 2014/0072346 | A1 | 3/2014 | Furutani et al. | |
| 2014/0072347 | A1 | 3/2014 | Furutani et al. | |
| 2014/0199092 | A1 | 7/2014 | Matsushita et al. | |
| 2014/0199094 | A1 | 7/2014 | Matsuzaki et al. | |
| 2014/0199096 | A1 | 7/2014 | Yoshida et al. | |

* cited by examiner (a)

(b)

(a)

(b)

DEVELOPER ACCOMMODATING CONTAINER, PROCESS CARTRIDGE AND ELECTROPHOTOGRAPHIC IMAGE FORMING APPARATUS

FIELD OF THE INVENTION AND RELATED ART

The present invention relates to a developer accommodating container for accommodating a developer, and a process cartridge, and an electrophotographic image forming apparatus which include the developer accommodating container.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

Further, the process cartridge refers to a cartridge, prepared by integrally assembling at least a developing means and a developing device, detachably mountable to a main assembly of the image forming apparatus and refers to a cartridge, prepared by integrally assembling the developing device and a photosensitive member unit including at least a photosensitive member, detachably mountable to the main assembly of the image forming apparatus.

Further, a developer accommodating container and the developer accommodating unit are accommodated in the image forming apparatus or the process cartridge. The developer accommodating unit container and the developer accommodating unit at least include a flexible container for accommodating the developer.

In a conventional electrophotographic image forming apparatus using the electrophotographic image forming process, a process cartridge type in which an electrophotographic photosensitive member and process means acting on the photosensitive member are integrally assembled into a cartridge and this cartridge is detachably mountable to a main assembly of the electrophotographic image forming apparatus is employed.

Further, for the purpose of preventing a phenomenon such that the developer is scattered into the main assembly in a developer filling step during manufacturing of the process cartridge, a constitution in which a deformable inside container is used has been devised (Japanese Laid-Open Patent Application (JP-A) Hei 04-66980). In this constitution, an object is to improve operativity of supply of the developer and to reducing a cost of a developer supplying device by preventing the scattering of the developer from the process cartridge into the main assembly of the image forming apparatus.

However, in the case where the developer is accommodated in such a deformable developer accommodating container, when the toner seal is unsealed, an opening of a developer accommodating member is pulled by the toner seal to be largely deformed and thus it becomes difficult to unseal the thickness seal (expose the opening) in some cases.

SUMMARY OF THE INVENTION

A principal object of the present invention is to provide a developer accommodating container capable of decreasing a degree of deformation of an opening to reduce a load necessary to peel a sealing member when the sheet is peeled from a flexible container at a periphery of the opening.

According to an aspect of the present invention, there is provided a developer accommodating container for accommodating a developer, comprising: a flexible container provided with an opening for permitting discharge of the developer; a sealing member for sealing the opening in a state in which the sealing member is bonded to a periphery of the opening, wherein the sealing member is capable of exposing the opening by being removed by pulling; and a reinforcing portion, provided at least as a part of the periphery of the opening, for decreasing a degree of deformation of the opening.

These and other objects, features and advantages of the present invention will become more apparent upon a consideration of the following description of the preferred embodiments of the present invention taken in conjunction with the accompanying drawings.

Figure 7:
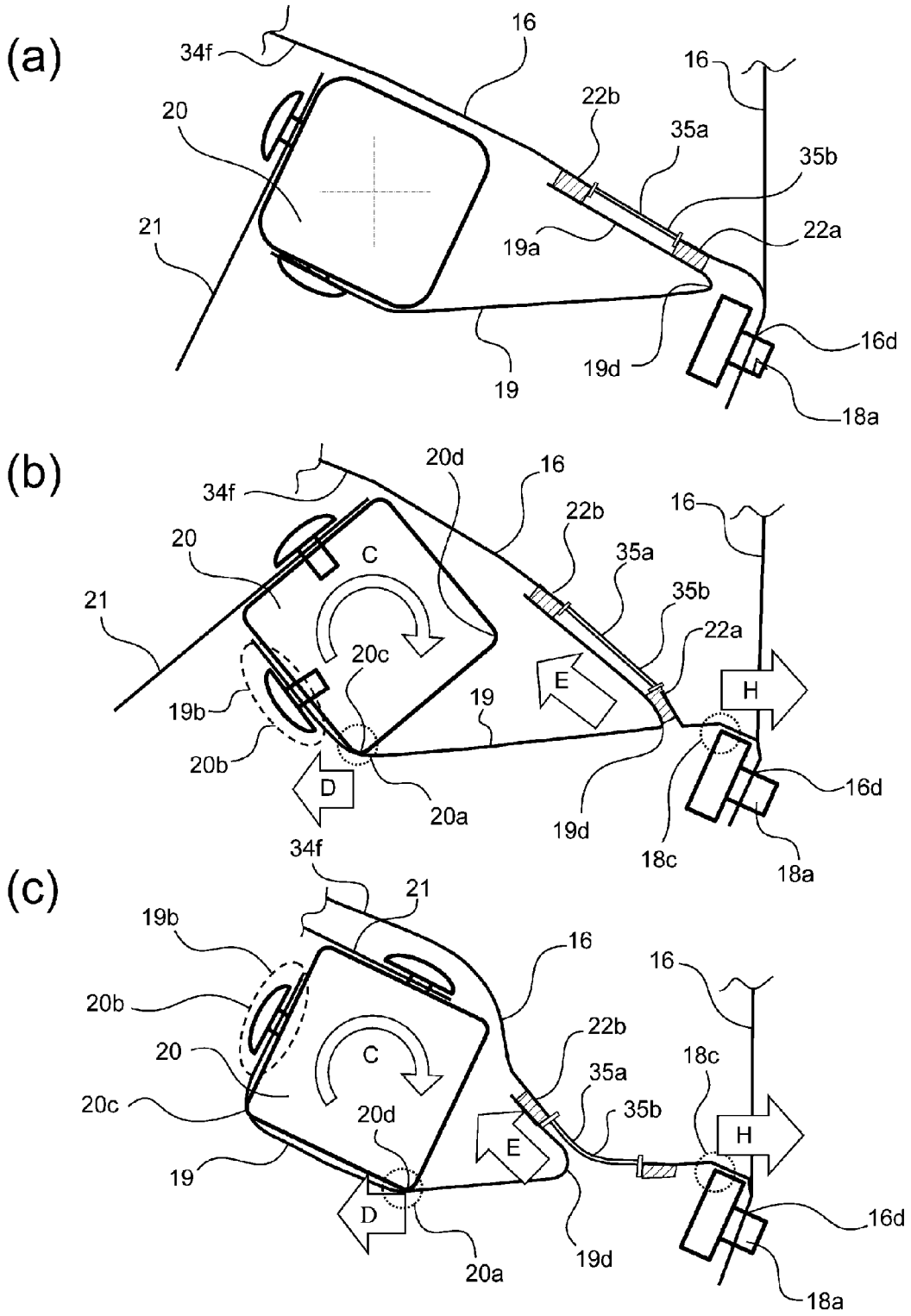

Parts (a), (b) and (c) of FIG. 7 show a state in which a discharging portion of a flexible container is folded back with respect to a direction (arrow E direction) in which unsealing advances, and are sectional views showing a state of the unsealing of the flexible container.

Figure 8:
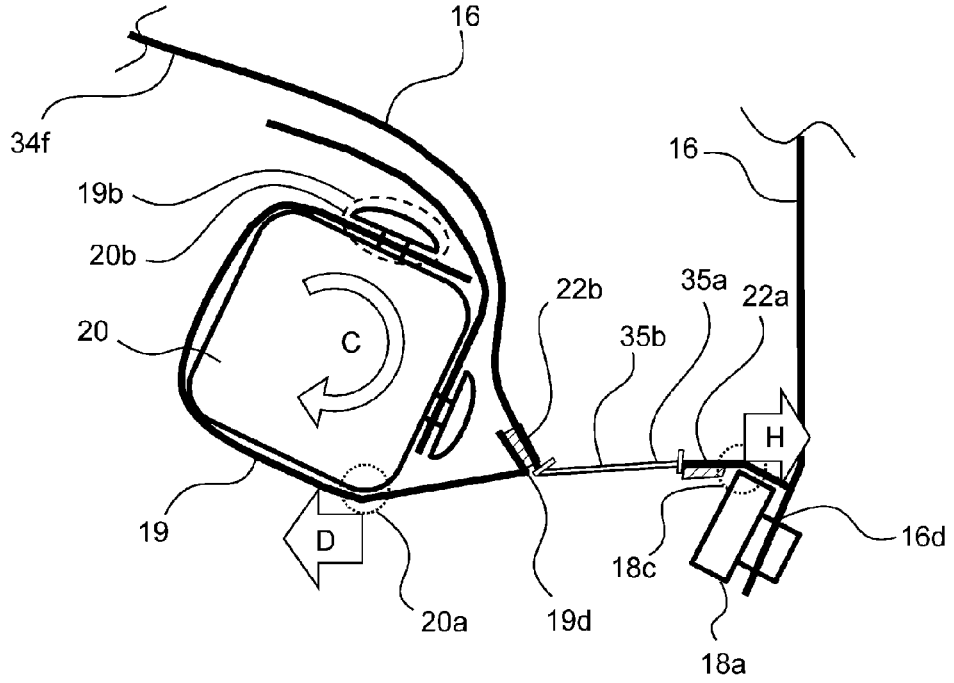
Figure 8:
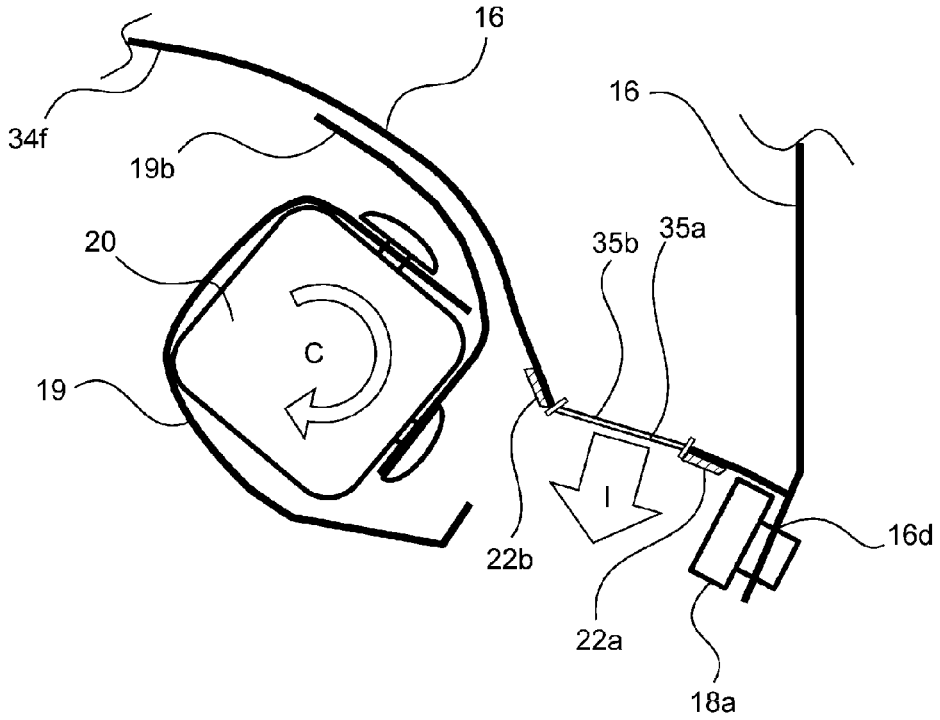

Parts (a) and (b) of FIG. 8 are sectional views showing the state of the unsealing of the flexible container.

Figure 9:
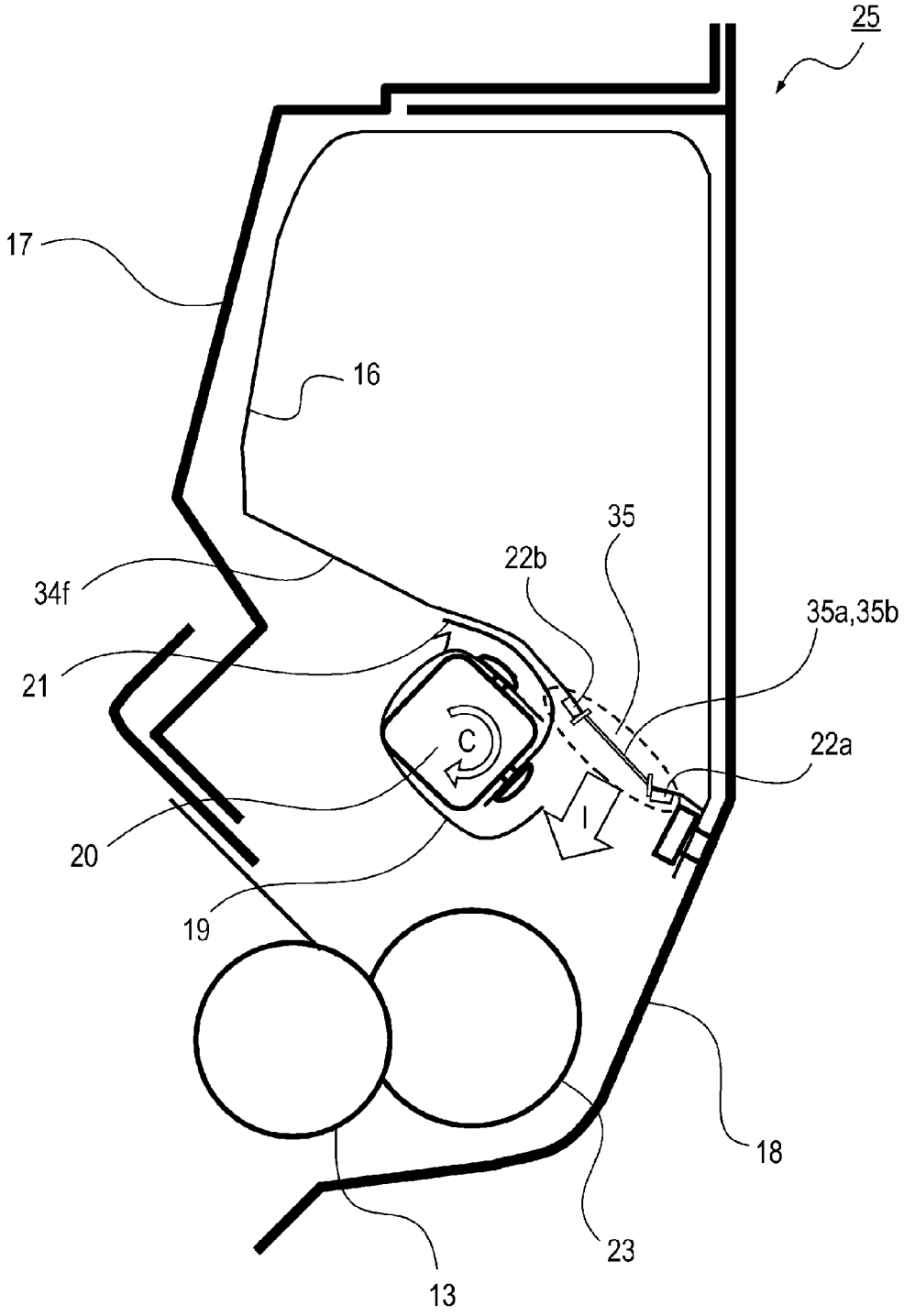

FIG. 9 is a sectional view showing a state in which the unsealing of the flexible container is completed.

Figure 10:
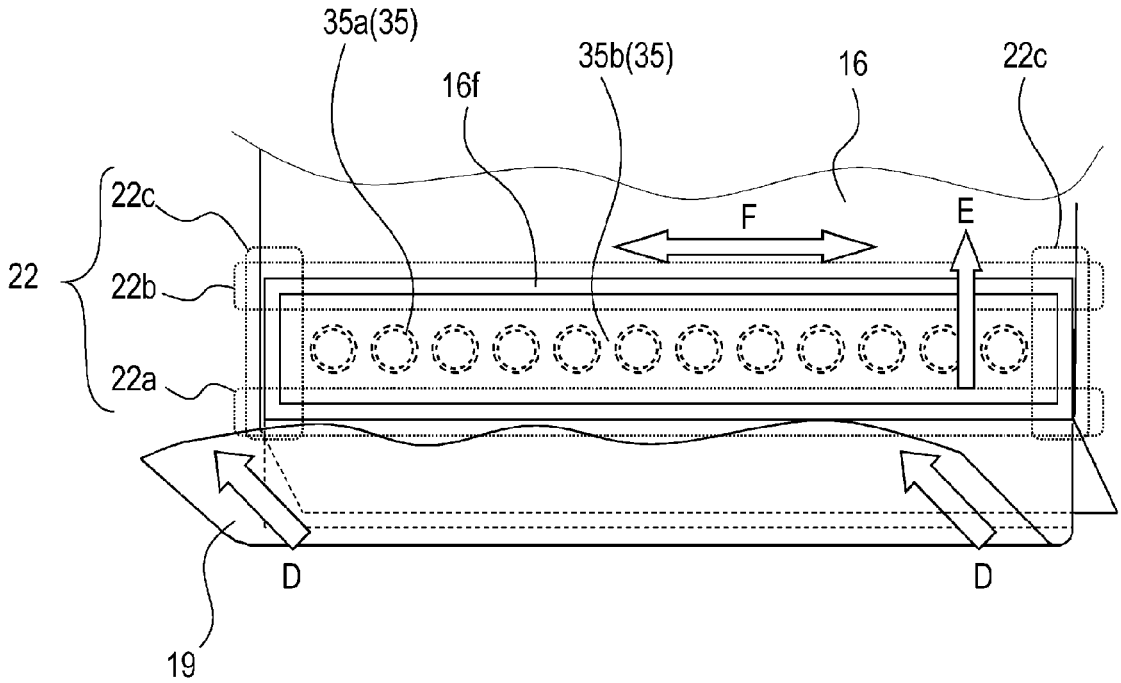

FIG. 10 is an illustration showing the discharging portion of the flexible container.

Figure 11:
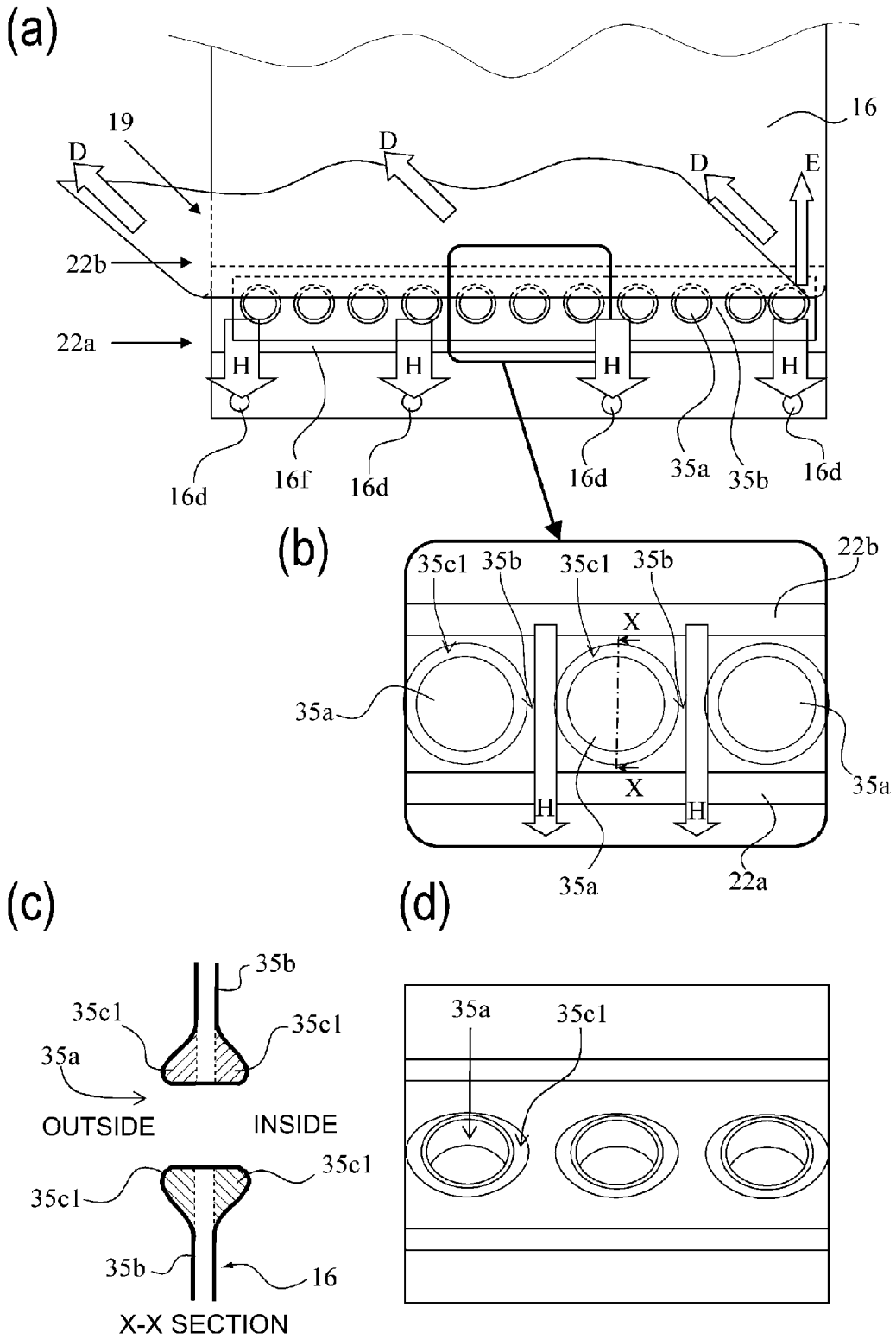

Parts (a) to (d) of FIG. 11 are schematic views for illustrating the opening.

Figure 12:
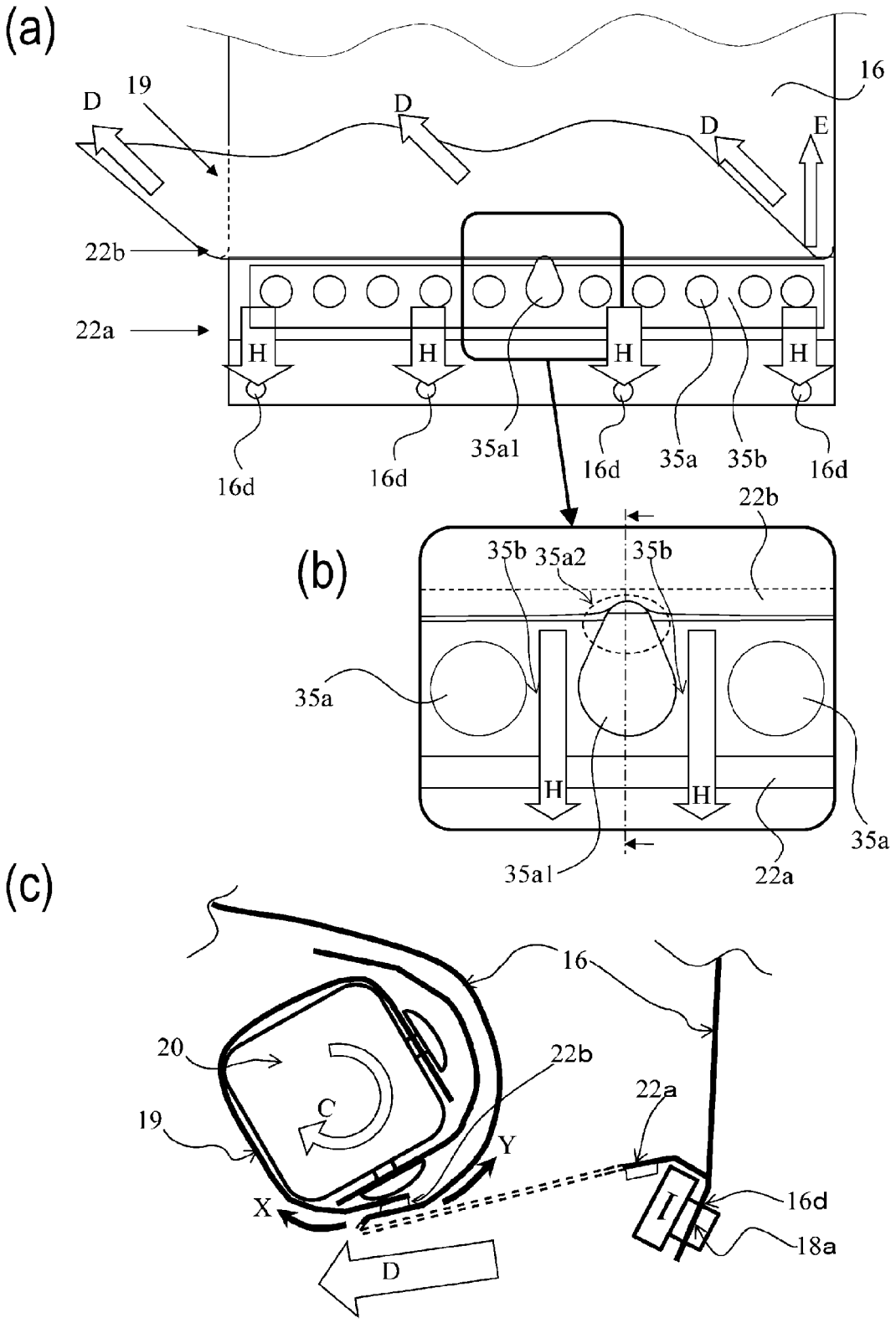

Parts (a), (b) and (c) of FIG. 12 are schematic views, in Comparison example, showing a state in which peeling of a sealing member advances in partway.

Figure 13:
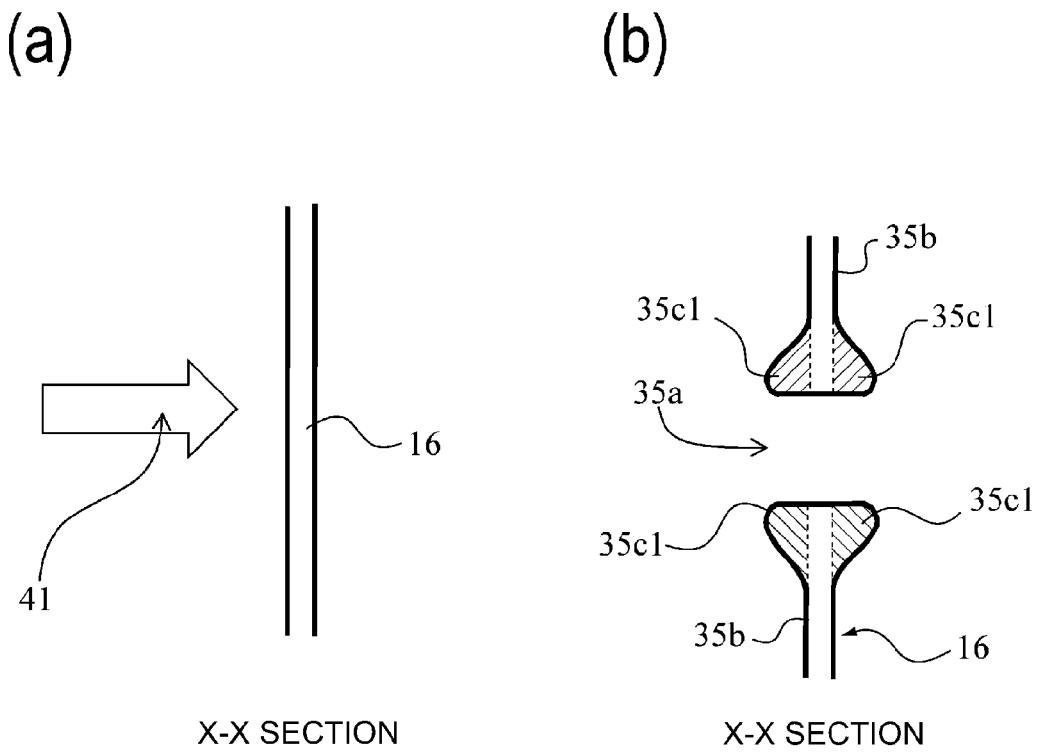

Parts (a) and (b) of FIG. 13 are schematic views for illustrating a process of generation of a reinforcing portion.

Figure 14:
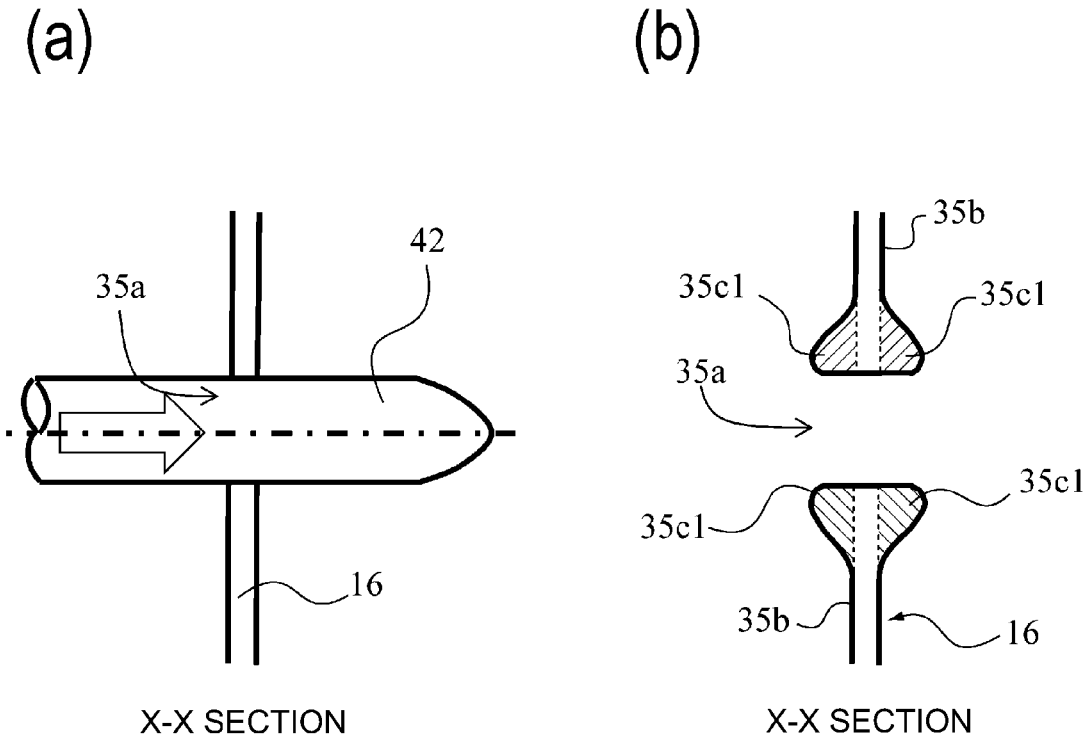

Parts (a) and (b) of FIG. 14 are schematic views for illustrating another process of generation of the reinforcing portion.

Figure 15:
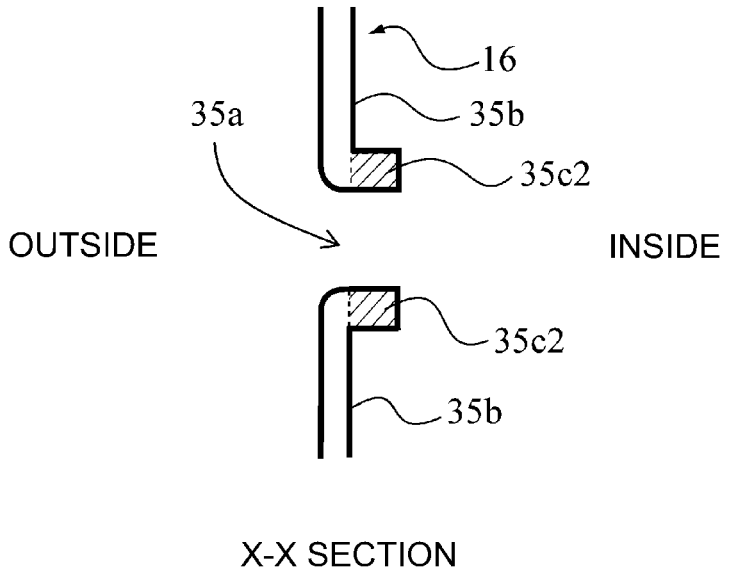
Figure 15:
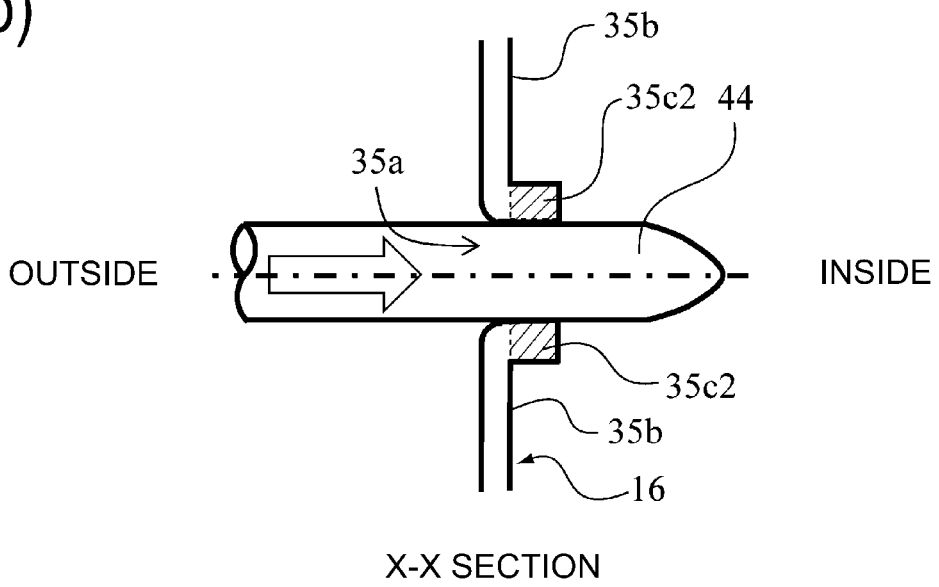

Parts (a) and (b) of FIG. 15 are schematic views including the schematic view, corresponding to (c) of FIG. 11 showing X-X cross-section of the opening in (b) of FIG. 11, in Embodiment 2.

Figure 16:
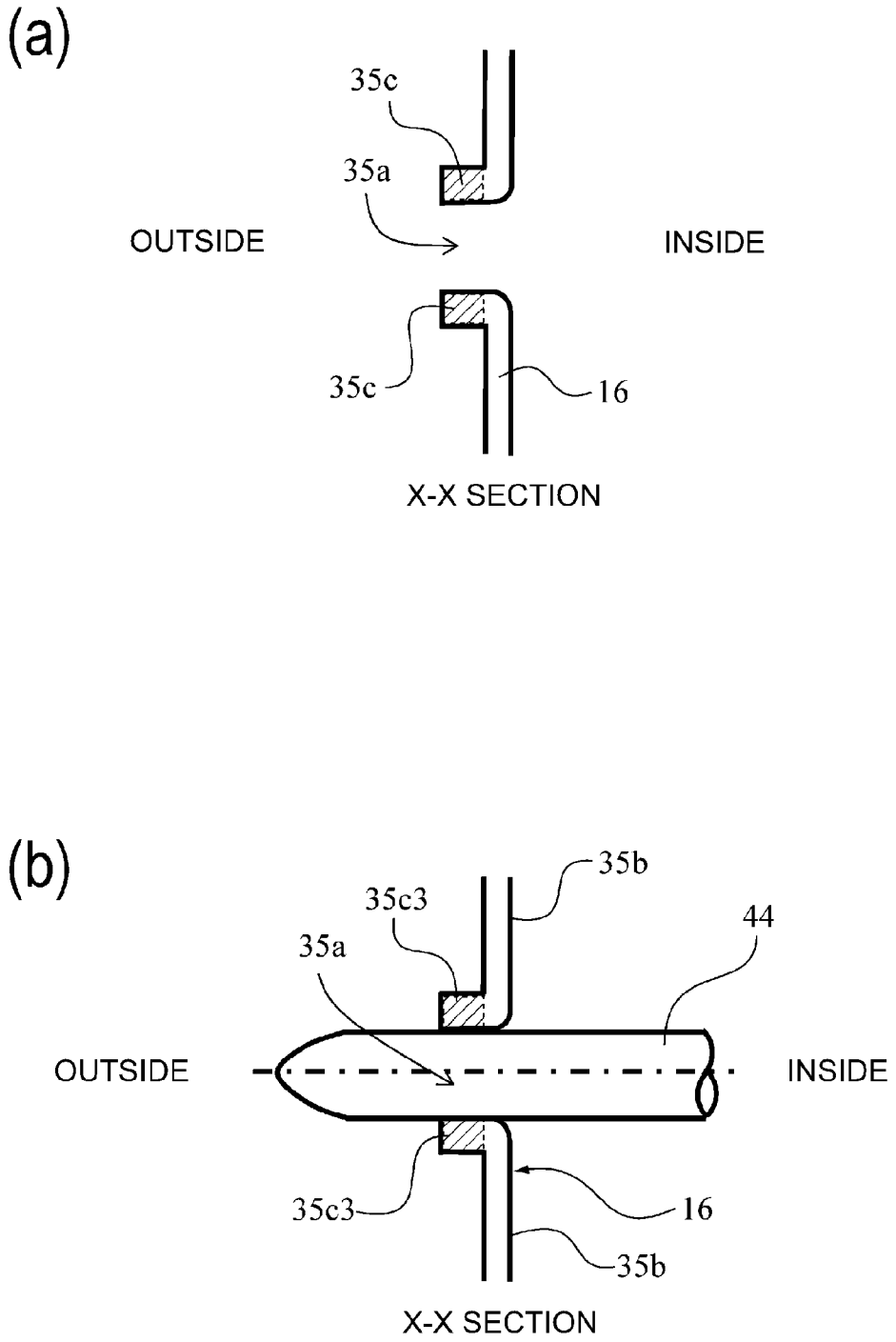

Parts (a) and (b) of FIG. 16 are schematic views including the schematic view, corresponding to (c) of FIG. 11 showing the X-X cross-section of the opening in (b) of FIG. 11, in Embodiment 3.

Figure 17:
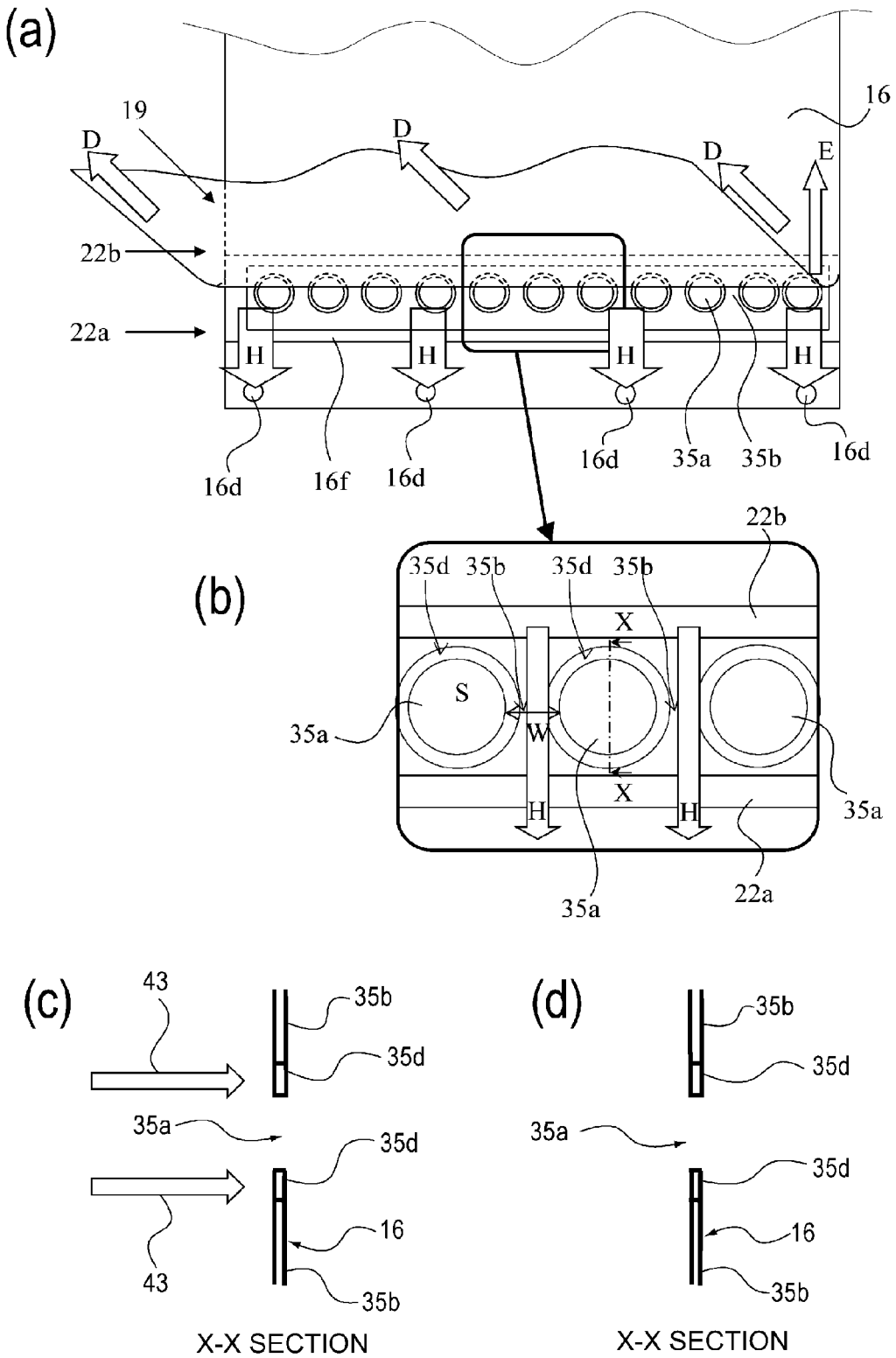

Parts (a) to (d) of FIG. 17 are schematic views, corresponding to those in FIG. 11, in Embodiment 4.

Figure 18:
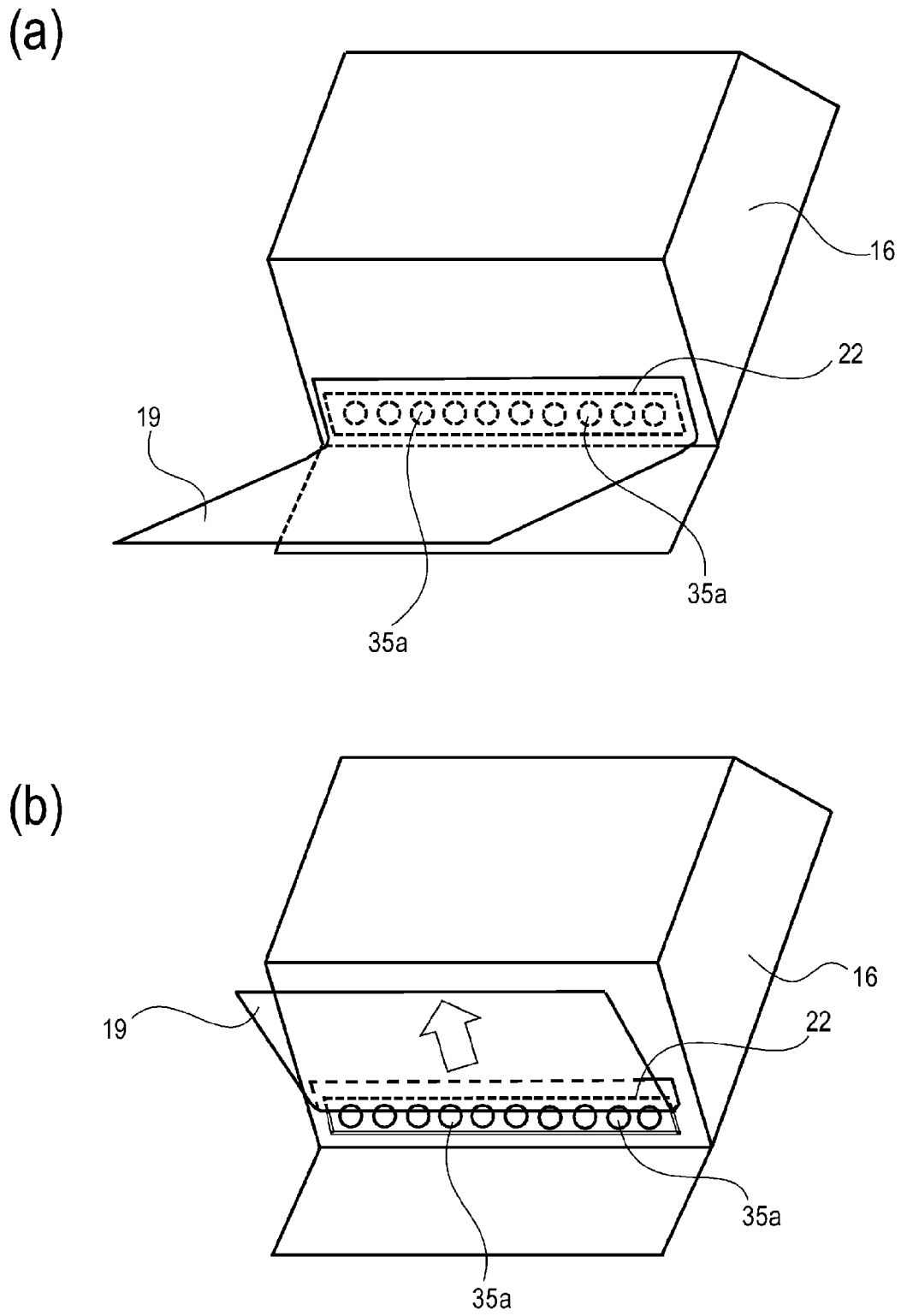

Parts (a) and (b) of FIG. 18 are perspective views for illustrating a developer accommodating container before unsealing and during the unsealing, respectively, in a reference example.

DESCRIPTION OF THE PREFERRED EMBODIMENTS

Embodiment 1

Figure 2:
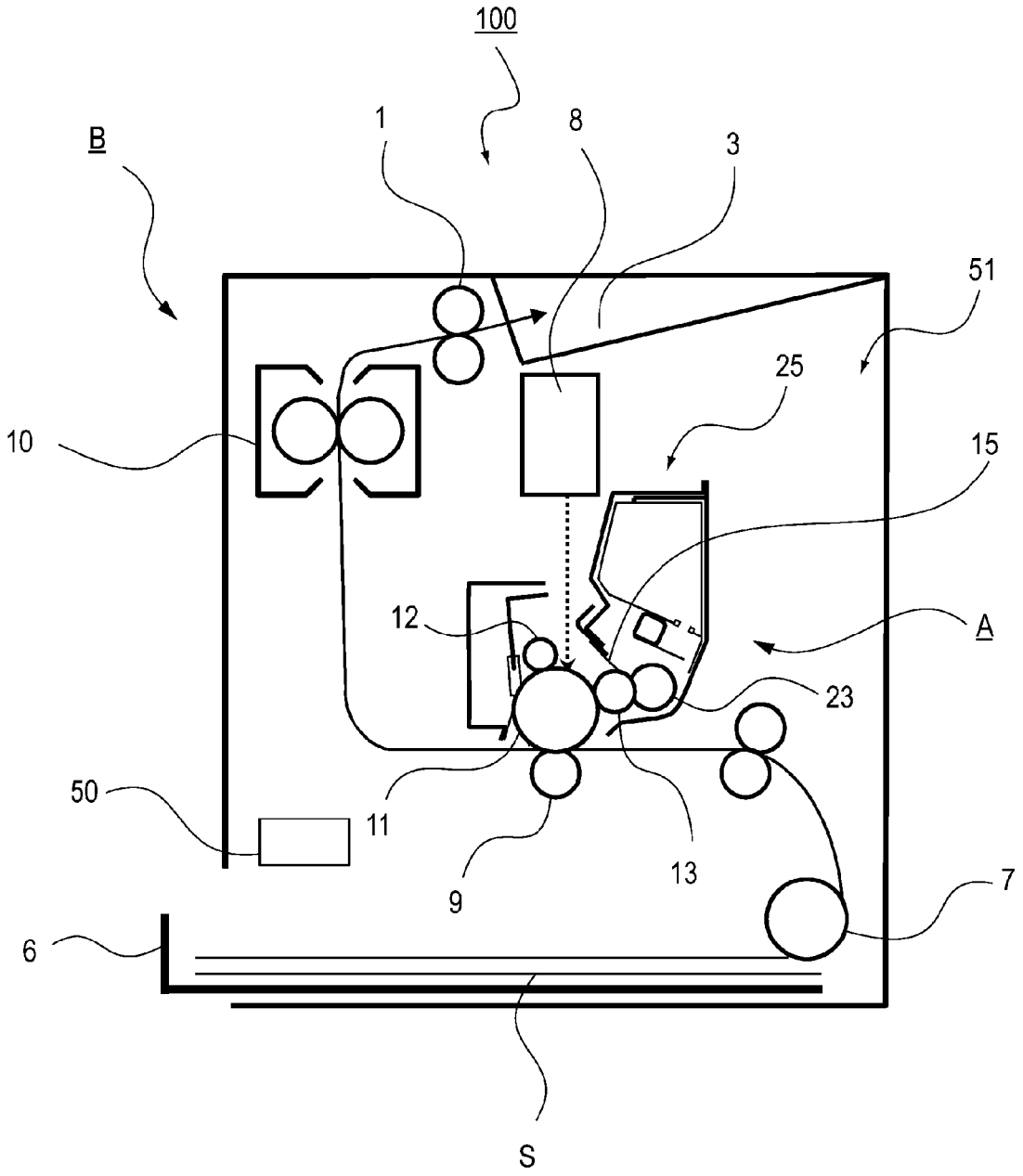
FIG. 2 is a sectional view showing a structure of an image forming apparatus.

FIG. 2 is a sectional view showing a structure of an image forming apparatus 100 including a flexible container according to Embodiment 1. As shown in FIG. 2, the image forming apparatus 100 as an electrophotographic image forming apparatus includes an apparatus main assembly B as an image forming apparatus main assembly and is constituted so that a cartridge A as a process cartridge is detachably mountable to the apparatus main assembly B. The cartridge A is prepared by integrally assembling a photosensitive drum 1 and a developer accommodating unit 25. In a sheet cassette 6 mounted to a lower portion of the apparatus main assembly B, sheets S are accommodated. During image formation, the sheet S is fed toward the photosensitive drum 11, as an electrophotographic photosensitive drum as an image bearing member, by a feeding roller 7.

In synchronism with this operation, the surface of the photosensitive drum 11 is electrically charged uniformly by a charging roller 12 and exposed to light by an exposure device 8, so that an electrostatic latent image is formed on the surface of the photosensitive drum 11. In the cartridge A, a developer is accommodated and a developing roller 13 as a developer carrying member is provided. The developer is fed to the developing roller 13 by a supplying roller 23 to be carried in a thin layer on the surface of the developing roller 13 by a developing blade 15. Then, a developing bias is applied to the developing roller 13, so that the above-described electrostatic latent image is developed with the developer and thus a developer image is formed on the surface of the photosensitive drum 11.

The developer image is transferred onto the conveyed sheet S by a transfer roller 9 supplied with a bias voltage. Then, the sheet S is conveyed to a fixing device 10 to fix the developer image thereon, and then is discharged onto a discharge portion 3 by a discharging roller pair 1. Incidentally, the apparatus main assembly B includes a controller 50, and the controller 50 controls drive of inside devices of the apparatus main assembly B. Further, although described later, the controller 50 controls drive of an urging sheet 21 (FIG. 1) so that the urging sheet 21 can repetitively urge a flexible container 16 (FIG. 1) by rotating the urging sheet 21. Incidentally, an image forming portion 51 for forming an image includes the photosensitive drum 11, the charging roller 12, the exposure device 8, the developing roller 13 and the fixing device 10, which are described above, and the like.

<Summary of Structure of Process Cartridge>

Figure 1:
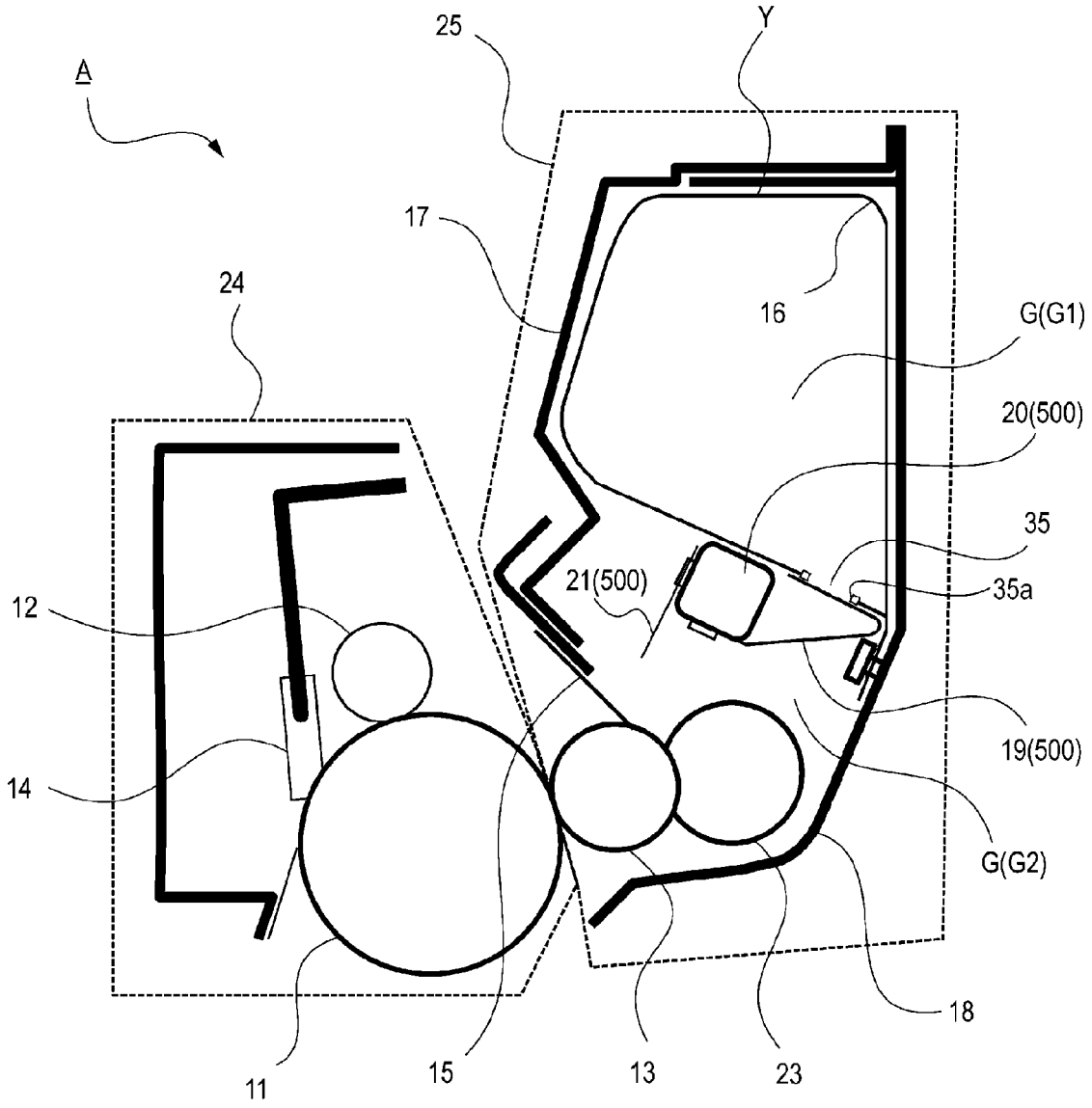
FIG. 1 is a sectional view showing a structure of a cartridge.

FIG. 1 is a sectional view showing a structure of the cartridge A. As shown in FIG. 1, the cartridge A includes a cleaner unit 24 and the developer accommodating unit 25. The cleaner unit 24 includes the photosensitive drum 11, a cleaning blade 14 for cleaning the surface of the photosensitive drum 11, and the charging roller 12 for electrically charging the surface of the photosensitive drum 11. The developer accommodating unit 25 includes the developing roller 13, the supplying roller 23 for supplying the developer to the developing roller 13, and the flexible container 16 for accommodating the developer. The developer accommodating unit 25 will be described specifically below.

The developer accommodating unit 25 includes a frame 17 as a first frame and a frame 18 as a second frame. In an upper region of the frames 17 and 18, the flexible container 16 and an urging member 500 (urging body or urging means) are disposed. The urging member 500 includes, although described later, the urging sheet 21, a sealing member 19 and a rotatable member 20. The present invention is characterized by the flexible container 16. The flexible container 16 is provided with openings 35*a* for permitting discharge of a developer G (G1), and is a container for accommodating the developer G (G1). In a lower region of the frames 17 and 18, the developing roller 13 and the supplying roller 23 are disposed. By employing such a constitution, the developer accommodating unit 25 is configured to accommodate the flexible container 16 containing the developer in the upper region of the frames 17 and 18 and to accommodate the developer G (G2) after being discharged from the flexible container 16 in the lower region of the frames 17 and 18.

The urging member 500 is disposed so as to oppose a lower surface of the flexible container 16. To the rotatable member 20, the sealing member 19 and the urging sheet 21 are fixed. The sealing member 19 is a member for urging the flexible container 16 after the sealing member 19 seals the openings 35*a* and then unseals the openings 35*a* by rotation of the rotatable member 20. Further, the urging sheet 21 urges, during or after an operation in which the sealing member 19 unseals the openings 35*a*, the lower surface of the flexible container 16 to deform the developer flexible container 16.

Here, the developer accommodating member refers to a container including the flexible container 16 and the sealing member 19 in combination.

<Summary of Structure of Developer Accommodating Unit>

Figure 4:
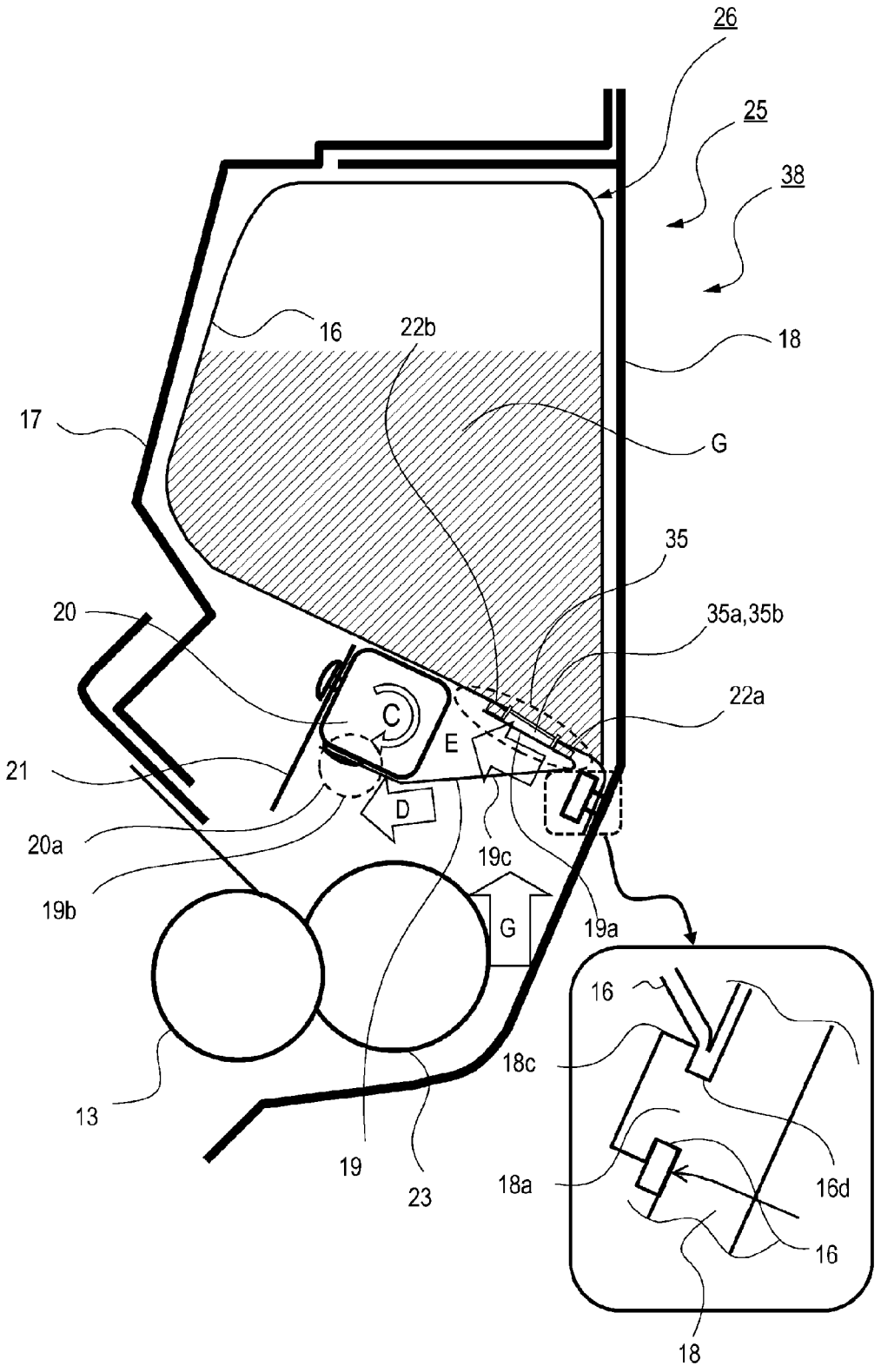
FIG. 4 is a sectional view showing a structure of a developer accommodating unit and shows a state in which a sealing portion of a sealing member closes an opening.
Figure 6:
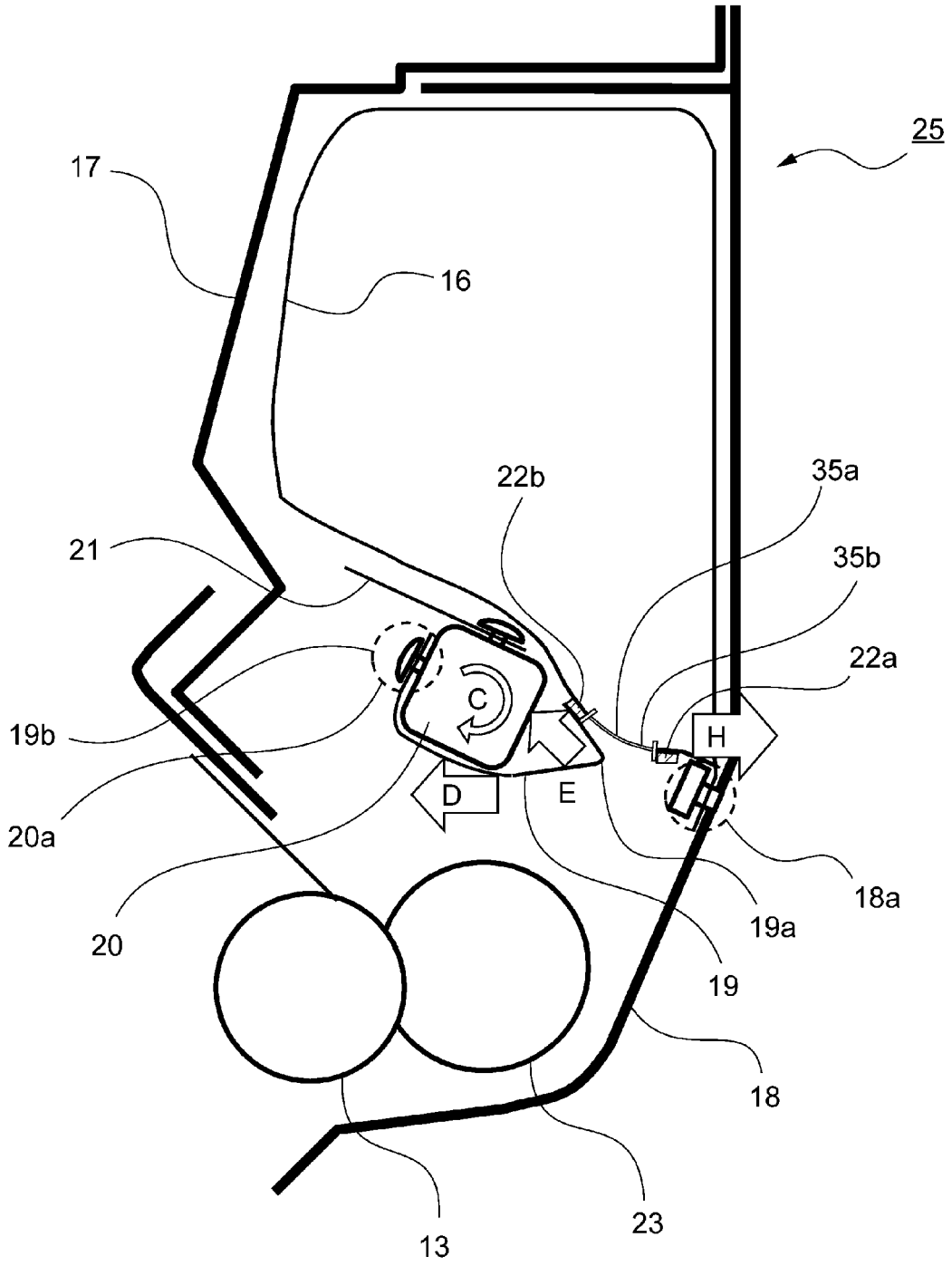
FIG. 6 is a sectional view showing the structure of the developer accommodating unit and shows a state in which the sealing portion of the sealing member opens the opening.

FIG. 4 is a sectional view showing a structure of the developer accommodating unit 25 and shows a state in which a sealing portion 19*a* of the sealing member 19 closes (covers) the openings 35*a*. FIG. 6 is a sectional view showing a structure of the developer accommodating unit 25 and shows a state in which the sealing portion 19*a* of the sealing member 19 opens (unseals) the openings 35*a*.

Figure 3:
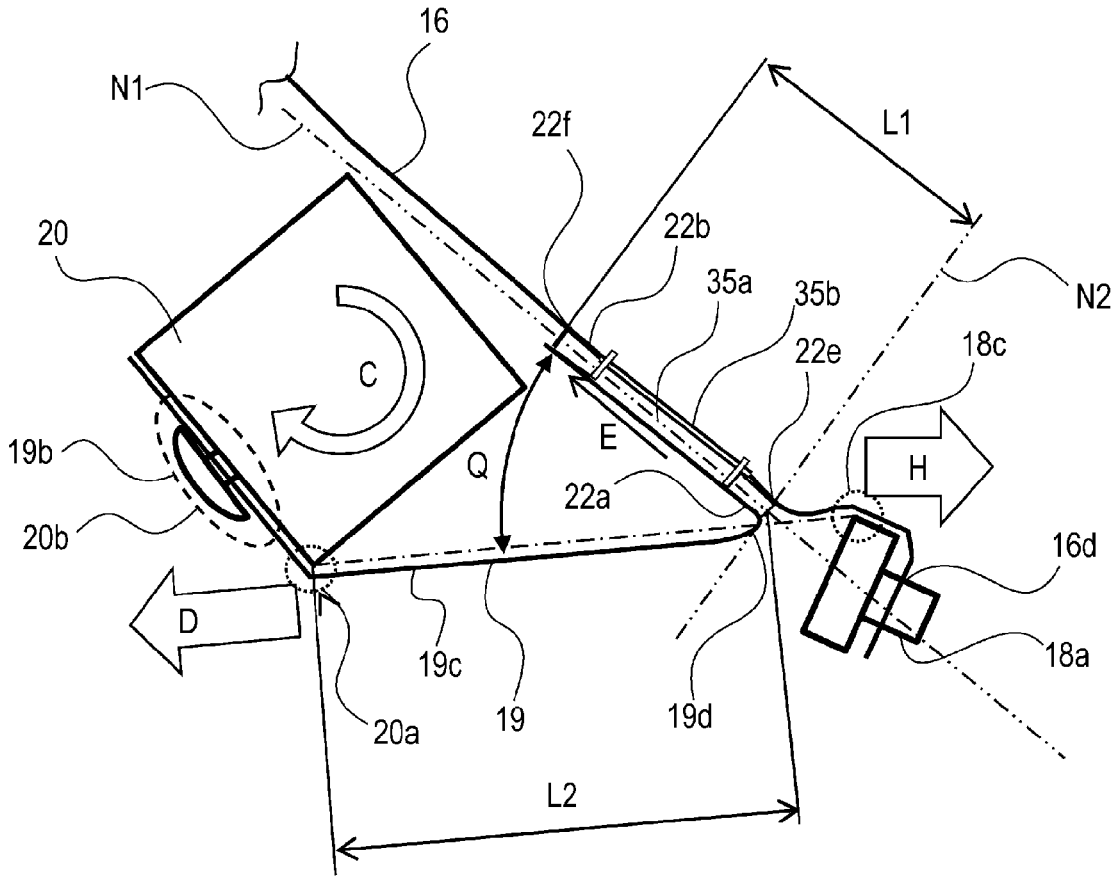
FIG. 3 is a sectional view at the instant when an unsealing member is unsealed.

As shown in FIG. 3, at a lower portion of the flexible container 16, fixed portions 16*d* for fixing the flexible container 16 to the frame 18 are formed. At a part of the surface of the flexible container 16, a discharging portion 35 extending in a longitudinal direction of the flexible container 16 is formed. The discharging portion 35 includes the openings 35*a* for permitting the discharge of the developer and connecting portions 35*b* for connecting (defining) the openings 35*a*.

At an opposing position to the surface of the flexible container 16, the rotatable member 20 is disposed. The rotatable member 20 is a member rotatable about its shaft (axis) as a rotation center. On the rotatable member 20, a base end portion of the sealing member 19 is fixed. Specifically, the sealing member 19 includes an engaged portion 19*b*, a connecting portion 19*c* and the sealing portion 19*a*. The engaged portion 19*b* is fixed on the rotatable member 20, and the sealing portion 19*a* is fixed on the discharging portion 35. When the rotatable member 20 is rotated in an arrow C direction, the sealing portion 19*a* opens the openings 35*a* (FIG. 6). The sealing member 19 is fixed on the rotatable member 20 at the engaged portion 19*b* by a retaining member (FIG. 4) and is fixed on the discharging portion 35 so as to block the openings 35*a* at an end portion thereof.

On the rotatable member 20, the urging sheet 21 is fixed. When the rotatable member 20 is rotated, the urging sheet 21 urges and urge-releases the flexible container 16 while being rotated. The urging sheet 21 is fixed on the rotatable member 20 at its base end portion by a retaining member. Further, the fixed portions 16*d* of the flexible container 16 are fixed to fixing portions 18*c* of the frame 18. Thus, the flexible container 16 is supported inside the frames 17 and 18.

(Structure of Discharging Portion of Flexible Container)

As shown in FIG. 10, the flexible container 16 includes the discharging portion 35. The discharging portion 35 includes the openings 35*a* and the connecting portions 35*b*. The openings 35*a* are provided at a plurality of positions of the discharging portion 35 of the flexible container 16 and are configured to permit the discharge of the inside developer. The connecting portions 35*b* connect the plurality of openings 35*a* and define an outer configuration of the flexible container 16.

Further, the discharging portion 35 is continuously surrounded by the bonding portion 22 to be unsealably bonded, so that the developer accommodated in the developer accommodating member 16 is sealed with the sealing member 19.

(Structure of Bonding Portion of Flexible Container)

The bonding portion 22 has a rectangular shape consisting of two lines extending in a long direction (arrow F direction) and two lines extending in a short direction (arrow E direction) so as to surround the discharging portion 35 and therefore the bonding portion 22 enables the sealing of the discharge portion 35.

Here, of the two lines of the welded bonding portion 22 extending in the long direction (arrow F direction), a bonding portion which is first unsealed is referred to as a first bonding portion 22*a* and a bonding portion which is unsealed later is referred to as a second bonding portion 22*b*. In this embodiment, in the case where the bonding portion 22 is viewed along the surface of the sealing member 19, a bonding portion closer to a fold-back portion 19*d* (FIG. 3) (or the engaged portion 19*b*) described later is the first bonding portion 22*a*. Further, a bonding portion opposing the first bonding portion 22*a* via the opening 35*a* is the second bonding portion 22*b*. Further, a bonding portion with respect to a widthwise direction (arrow E direction) is a widthwise bonding portion 22*c*.

In this embodiment, an unsealing direction is the arrow E direction. The unsealing direction is defined as follows. In the case where the unsealing is effected by moving the sealing member 19, of the first bonding portion 22*a* and the second bonding portion 22*b* opposing to each other via the openings 35*a*, the first bonding portion 22*a* is first unsealed (peeled). Thus, a direction directed from the first bonding portion 22*a* to be first unsealed toward the second bonding portion 22*b* is the unsealing direction (arrow E direction).

When the sealing member 19 is unsealed (peeled) from the flexible container 16 in the arrow E direction, in some cases, the peeling microscopically progresses also in the arrow F direction due to the deformation of the flexible container 16 by an unsealing force also in the first bonding portion 22*a* and in the second bonding portion 22*b*. However, the unsealing direction in this embodiment does not refer to such a microscopic unsealing direction.

(Disposition of Openings of Flexible Container)

Next, disposition of the openings 35*a* will be described with reference to FIGS. 10 and 11. The movement direction (in which the sealing member 19 is pulled by the rotatable member 20) of the sealing member 19 for sealing the openings 35*a* and for exposing the openings 35*a* by being moved is an arrow D direction. By the movement of the sealing member 19, the exposure of the openings 35*a* progresses in the unsealing direction (arrow E direction). In the following, the movement direction of the sealing member 19 is the arrow D direction. The plurality of openings 35*a* and the plurality of connecting portions 35*b* are alternately disposed along the arrow F direction (FIG. 10) perpendicular to the unsealing direction (arrow E direction). Further, the sealing member 19 is configured to be wound up by rotating the rotatable member 20 but the arrow F direction is the same direction as an axis (shaft) of the rotatable member 20.

(Shape and Direction of Openings of Flexible Container)

Each of the plurality of openings 35*a* in this embodiment has a circular shape. Further, the shape of each opening 35*a* may also be, in addition to the circular shape, a polygonal shape such as a rectangular shape, an elongated circular shape, and the like shape.

Part (a) of FIG. 11 is a partly enlarged plan view of (a) of FIG. 11. Part (c) of FIG. 11 is a sectional view taken along X-X line indicated in (b) of FIG. 11. Part (d) of FIG. 11 is a partly enlarged perspective view of the flexible container 16. As shown in (b) of FIG. 11, the flexible container 16 which is a "flexible container" as a part of the developer accommodating container 26 for accommodating the developer includes the openings 35*a* for permitting discharge of the developer. The flexible container 16 also includes the connecting portions 35*b* each provided between adjacent two openings 35*a*. The sealing member 19 seals the openings in a state in which the sealing member 19 is bonded to the connecting portions 35*b* located at a periphery of the openings 35*a*, and exposes the openings 35*a* when a pulling force is exerted on the sealing member 19. A reinforcing portion 35*c*1 is formed in a ring-like shape at the periphery of each of the openings 35*a* to decrease a degree of deformation of the openings 35*a*. Incidentally, the reinforcing portion 35*c*1 may only be required to be provided at least at a part of the periphery of the opening 35*a*. For example, "at least at a part of the periphery of the opening 35*a*", the reinforcing portion 35*c*1 may also be a ring-like portion expanded from the opening 35*a* by a predetermined dimension or may also be not formed at a part of the periphery of the opening 35*a* with respect to a circumferential direction. The reinforcing portion 35*c*1 may only be required to be disposed as a part of the periphery of the opening 35*a* of the flexible container 16.

The reinforcing portion 35*c*1 is, as shown in (b) of FIG. 11, provided along an edge of the opening 35*a*, and is, indicated by hatched lines in (c) of FIG. 11, formed so as to be projected toward an inside and an outside of the flexible container 16. In this embodiment, the reinforcing portions 35*c*1 are integrally molded with the connecting portions 35*b*.

Parts (a) and (b) of FIG. 13 are schematic views for illustrating a process of generation of the reinforcing portions 31*c*1. Particularly, (a) of FIG. 13 is the schematic view before processing of the opening 35*a* in X-X cross-section of the opening 35*a* in (b) of FIG. 11, and (b) of FIG. 13 is the schematic view after the processing (similar to (c) of FIG. 11). The opening 35*a* is formed as shown in (b) of FIG. 13 by using laser (beam) machining in which the flexible container 16 is irradiated with appropriate laser light (beam) 41 as shown in (a) of FIG. 13 to generate an opening in a shape depending on a locus of the laser light irradiation. The reinforcing portion 35*c*1 is formed at an edge of the opening 35*a* simultaneously with the generation of the opening 35*a* by the laser processing. Further, by heat of the laser light, a portion of the connecting portion 35*b*, i.e., a portion of the surface of the flexible container 16 before the formation of the opening 35*a* is concentrated at the portion of the reinforcing portion 35*c*1. As a result, a thickness of the reinforcing portion 35*c*1 is larger than a thickness of the connecting portion 35*b*.

Parts (a) and (b) of FIG. 14 are schematic views for illustrating a process, of generation of the reinforcing portion 31*c*1, different from the process shown in (a) and (b) of FIG. 13. Particularly, (a) of FIG. 14 is the schematic view during processing of the opening 35*a* in X-X cross-section of the opening 35*a* in (b) of FIG. 11, and (b) of FIG. 14 is the schematic view after the processing (similar to (c) of FIG.

11). As shown in FIG. 14, the opening 35*a* is formed by operating a working tool 42 for machining with respect to an arrow direction in (a) of FIG. 14. At this time, by heating the working tool 42, an edge of the opening 35*a* of the flexible container 16 is melted. As a result, the reinforcing portion 35*c*1 is formed at the edge of the opening 35*a*.

Further, the direction of the openings 35*a* may preferably be such that the developer accommodated in the developer bag 16 is easily discharged in an attitude during image formation. For that reason, in the attitude during image formation, the openings 35*a* are disposed so as to be open downward with respect to the gravitational direction. The state in which the openings 35*a* open downward with respect to the gravitational direction refers to that the direction of the openings 35*a* has a downward component with respect to the gravitational direction.

(Fixing Between Flexible Container and Frame)

As shown in FIG. 11, the fixed portion 16*d* of the flexible container 16 receives a force when the sealing member 19 is unsealed (removed) from the flexible container 16 as described later. A plurality of fixed portions 16*d* are provided in parallel to a direction F along which the plurality of openings 35*a* are arranged. Different from the arrangement of the plurality of fixed portions 16*d*, a single fixed portion 16*d* elongated in parallel to the direction F may also be formed. The fixed portions 16*d* are positioned in the neighborhood of the openings 35*a* of the flexible container 16.

The fixing portions 16*d* are fixing portions necessary for the time of unsealing the flexible container 16, and its action and arrangement will be described later in the description of the unsealing.

<Structure of Sealing Member>

As shown in FIG. 4, the sealing member 19 covers the discharging portion 35 of the flexible container 16 before use of the cartridge A to confine the developer in the flexible container 16. The sealing member 19 is moved, so that the openings 35*a* are exposed. The sealing member 19 is constituted by a sheet-like sealing member including a sealing portion 19*a* for covering (sealing) the discharging portion 35 of the flexible container 16, an engaged portion 19*b* to be fixed (engaged) with the rotatable member 20 described later, and a connecting portion 19*c* which connects the sealing portion 19*a* and the engaged portion 19*b*. The sheet-like sealing member is formed of a laminate material having a sealant layer which exhibits an easy-unsealing property described later, and a base material therefor is polyethylene telephthalate (PET), polyethylene, polypropylene or the like. A thickness of the sheet-like sealing member may appropriately be set in a range of 0.03-0.15 mm.

(Sealing Portion of Sealing Member)

A sealing portion 19*a* refers to a region where the sealing member 19 covers the plurality of openings 35*a* and connecting portions 35*b* of the flexible container 16 to seal the openings 35*a*. By the sealing portion 19*a*, the developer is prevented from being leaked from the inside of the flexible container 16 until before use of the cartridge A.

(Engaging portion of sealing member)

The sealing member 19 has a free end portion in one end side thereof with respect to the unsealing direction E, and at the free end portion, the engaged portion 19*b* to be engaged with the rotatable member 20 for moving the sealing member 19 is provided. With the engaged portion 19*b*, the rotatable member 20 for moving the sealing member to expose the openings 35*a* is engaged. The rotatable member 20 may also be configured to be automatically subjected to the unsealing (pealing) by receiving a driving force from the image forming apparatus main assembly B. Or, the rotatable member 20 may also be configured to be subjected to the unsealing (peeling) by being held and moved by the user. In this embodiment, the rotatable member 20 is a rotation shaft provided in the frame, and the sealing member 19 engaged with the rotatable member 20 is pulled, so that the flexible container 16 accommodating the developer is unsealed.

(Connecting Portion of Sealing Member)

A plurality of connecting the bonding portion 22 and the engaged portion 19*b* is the connecting portion 19*c*. The connecting portion 19*c* is a portion for transmitting a force so as to pull off the bonding portions 22 by receiving the force from the rotatable member 20.

(Folding-Back of Connecting Portion)

Referring to FIG. 3, a plane formed between the first bonding portion 22*a* and the second bonding portion 22*b* at the moment of the unsealing is taken as N1. A plane which is perpendicular to the plane N1 and which passes through the first bonding portion 22*a* is taken as N2.

The rotatable member 20 is disposed closer to the second bonding portion 22*b* than the plane N2 passing through the first bonding portion 22*a*. In other words, the sealing member 19 includes when it is seen along the surface of the sheet-like sealing member 19, a fold-back portion 19*d* where the sealing member 19 is folded back at the portion (connecting portion 19*c*) between the connecting portion 22 and the engaged portion 19*b* engaged with the rotatable member 20. The fold-back portion 19*d* may be provided with or not provided with a fold (crease). A folding angle Q of the sealing member 19 may preferably be 90 degrees or less. The folding angle Q is an angle Q between a plane of the bonding portion 22 of the flexible container 16 and a plane along the arrow D direction in which the sealing member 19 is pulled.

(Fixing of Sealing Member)

Further, fixing between the sealing member 19 and the rotatable member 20 is, in this embodiment, made by the ultrasonic clamping similarly as in the case of the fixed portion 16*d*. Other than the ultrasonic clamping, the fixing may also be made by the (heat) welding, the ultrasonic welding, the bonding, the insertion between the frames, the hooking by a hole and a projection, or the like similarly as the means for fixing the fixed portion 16*d*.

(Portion Having Easy-Unsealing Property of Sealing Member)

A method of providing a peeling force of the bonding portion 22 with a desired value will be described. In this embodiment, in order to provide the peeling force with the desired value (a minimum force within a range in which the toner sealing property can be maintained), two methods are principally employed.

In a first method, a laminate material having a sealant layer for enabling easy unsealing of the sealing member is applied. Further, the first method is a method in which the easy unsealing is enabled at the bonding portion by using, as the material for the flexible container 16, a sheet material (of, e.g., polyethylene or polypropylene) which is weldable with the sealant layer and which has flexibility. By changing a combination of formulation of the sealant layer with the material to be bonded, the peeling force can be adjusted correspondingly to a desired condition. In this embodiment, a material having a peeling strength of about 3N/15 mm measured by testing methods for heat sealed flexible packages (JIS-Z0238) is used.

A second method is a method in which as shown in FIGS. 3, 4 and 7, the discharging portion 35 of the flexible container 16 is placed in a state in which the sealing member 19 is folded back with respect to an unsealing direction (arrow E direction). For example, in the state of FIG. 4, the rotatable member 20 is rotated in the rotational direction (arrow C direction), so that the sealing member 19 is pulled in a pulling direction (arrow D direction) by the rotatable member 20. As a result, the flexible container 16 and the sealing member 19 provide an inclined peeling positional relationship, as shown in FIG. 3, in which the angle Q between the plane of the bonding portion 22 of the flexible container 16 and the plane along the pulling direction (arrow D direction) of the sealing member 19 is 90 degrees or more. It has been conventionally known that the peeling force necessary to separate the both surfaces can be reduced by establishing the inclined peeling positional relationship. Therefore, as described above, the discharging portion 35 is placed in the state in which the sealing member 19 is folded back with respect to the unsealing direction (arrow E direction), so that the sealing member 19 of the bonding portion 22 and the flexible container 16 are placed in the inclined peeling positional relationship and thus the peeling force can be adjusted so as to be reduced.

<Structure of Rotatable Member>

The rotatable member 20 is used for the purpose of peeling the sealing member 19 from the flexible container 16 by applying a force to the sealing member 19 to move the sealing member 19. The rotatable member 20 includes a supporting portion (not shown) which has a shaft shape and which is rotatably supported by the second frame 18 at its ends, and includes an engaging portion 20*b* to which the engaged portion 19*b* of the sealing member 19. In this embodiment, the rotatable member 20 has a rectangular shaft shape, and the engaged portion 19*b* of the sealing member 19 is engaged with the engaging portion 20*b* at one of four sides of the rectangular shaft.

<Summary of Unsealing of Flexible Container>

The unsealing of the flexible container 16 will be described with reference to FIGS. 4 to 8.

For unsealing the flexible container 16, the developer accommodating unit 25 includes a power application point portion 20*a* where the rotatable member 20 applies the force for pulling the sealing member 19, and includes the fixing portion 18*a* of the frame for fixing the flexible container 16 to be pulled.

The power application point portion 20*a* is a portion, closest to the bonding portion 22, of a portion where the sealing member 19 and the rotatable member 20 contact at the moment of the unsealing. In (b) of FIG. 7, a corner portion 20*c* of the rotatable member 20 constitutes the power application point portion 20*a*. The fixing portion 18*a* of the frame 18 includes a fixing portion 18*c* for suppressing movement of the flexible container 16 caused by the force during the unsealing. In this embodiment, the first fixing portion 18*a* of the frame 18 and the fixed portion 16*d* of the flexible container 16 are bonded to each other by the ultrasonic clamping. As shown in (b) and (c) of FIG. 7 and (a) of FIG. 8, a portion, closer to the bonding portion 22, of the first fixing portion 18*a* bonded by the ultrasonic clamping constitutes the fixing portion 18*c*.

As shown in FIG. 4, the rotatable member 20 is rotated in the arrow C direction by transmission of the driving force thereto by an unshown driving means provided to the apparatus main assembly B.

Figure 5:
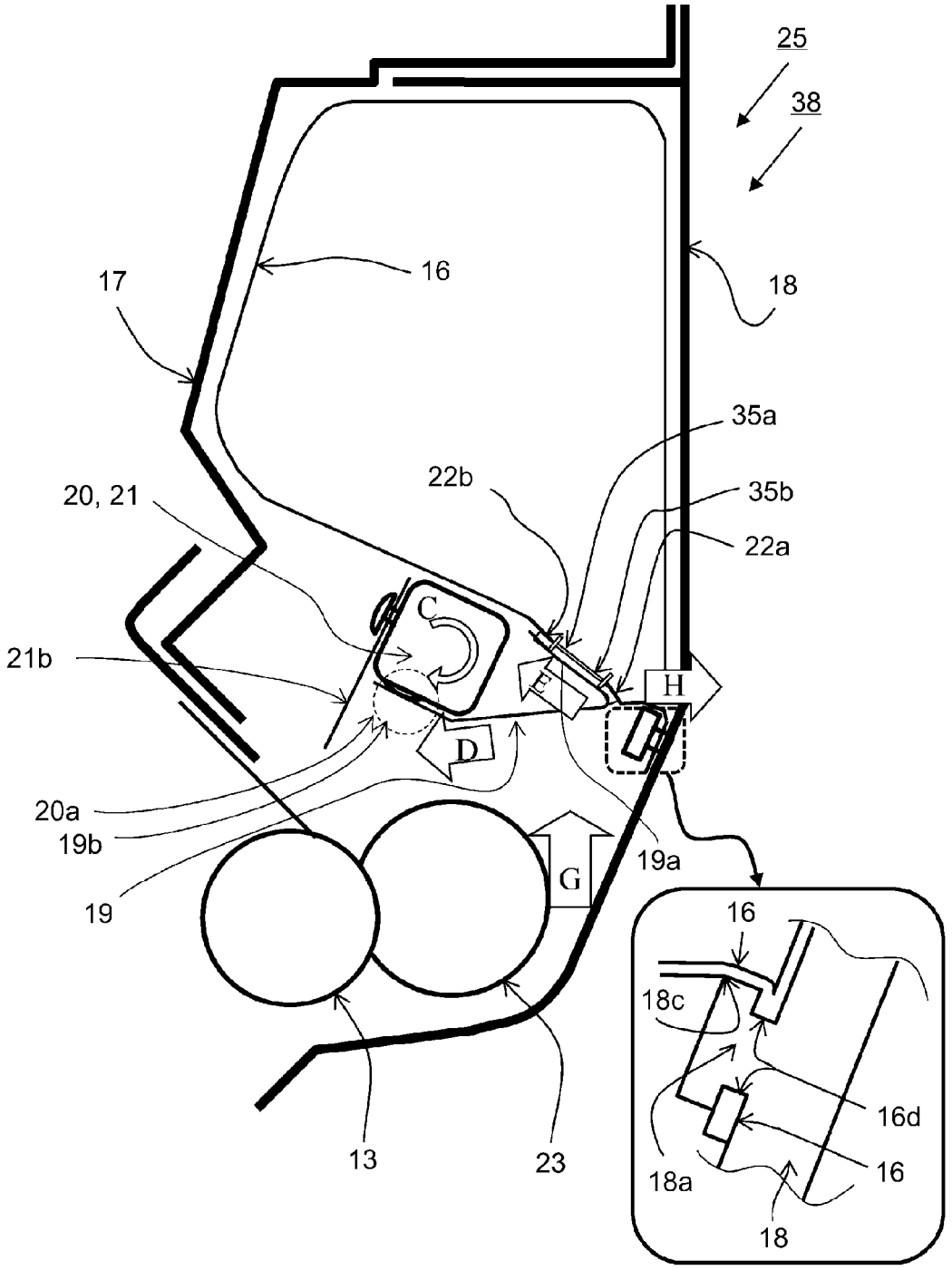
FIG. 5 is a sectional view showing a state immediately before unsealing of a first bonding portion started by the advance of rotation of a rotatable member to pull the sealing member.

A state immediately before the sealing member 19 is pulled by further rotation of the rotatable member 20 to start the unsealing is shown in FIG. 5 and (c) of FIG. 7. With the rotation, the sealing member 19 fixed to the rotatable member 20 by the engaged portion 19*b* is pulled in the arrow D direction by the corner portion 20*c* (power application point portion 20*a*) of the rectangular rotatable member 20.

When the sealing member 19 is pulled, the flexible container 16 is pulled via the bonding portion 22. Then, a force is applied to the fixed portion 16*d* of the flexible container 16, so that the flexible container 16 is pulled from the fixing portion 18*c* toward the power application point portion 20*b* by the fixing portion 18*c*. Then, in a cross section perpendicular to the rotation shaft of the rotatable member 20, the first bonding portion 22*a* is moved to approach a line connecting the power application point portion 20*a* and the fixing portion 18*c*. At this time, with respect to the arrow D direction, from a side close to the rotation shaft of the rotatable member 20, the portions are disposed in the order of the openings 35*a*, the first bonding portion 22*a*, the fold-back portion 19*d* and the fixing portion 18*c* ((b) of FIG. 7). Further, the unsealing member 19 is folded back between the first bonding portion 22*a* and the engaged portion 19*b* and therefore the force is applied to the portion of the first bonding portion 22*a* so as to be inclination-peeled in the arrow D direction. Then, the peeling of the first bonding portion 22*a* is effected to start the unsealing of the discharging portion 35.

Together with the corner portion 20*c*, also the power application point portion 20*a* is moved in the arrow C direction, and when the sealing member contacts a corner portion 20*d*, the power application point portion 20*a* is moved from the corner portion 20*c* to the corner portion 20*d*. Part (b) of FIG. 7 shows a state in which the power application point portion 20*a* is the corner portion 20*c*, and (c) of FIG. 7 shows a state in which the rotatable member 20 in further rotated and thus the power application point portion 20*a* is moved to the corner portion 20*d*.

As shown in FIG. 6 and (c) of FIG. 7, when the unsealing is advanced with further rotation of the rotatable member 20, also the fold-back portion 19*d* is moved in the arrow E direction. Then, the unsealing is further advanced, so that the openings 35*a* are exposed. A state in which the peeling of the second bonding portion 22*b* is to be started after the openings 35*a* are exposed is shown in (a) of FIG. 8. Also at this time, similarly as in the case of the peeling of the first bonding portion 22*a*, the sealing member 19 is pulled toward the power application point portion 20*a*, and the flexible container 16 stands firm toward a direction of the fixing portion 18*c* (an arrow H direction). Then, in a cross section perpendicular to the rotation shaft of the rotatable member 20, the second bonding portion 20*b* is moved to approach a line connecting the power application point portion 20*a* and the fixing portion 18*c*. Then, the force is applied to the portion of the bonding portion 22*b* in the arrow D direction, so that the second bonding portion 22*b* is separated. Thus, the second bonding portion 222*b* is peeled to complete the unsealing ((b) of FIG. 8 and FIG. 9). Then, the developer inside the flexible container 16 is discharged in an arrow I direction through the openings 35*a* of the discharging portion 35.

Thus, the sealing member 19 is wound up around the rotatable member 20 by the rotation of the rotatable member 20, so that the bonding portion 22 is unsealed. The sealing member 19 is wound up by the rotation of the rotatable member 20, and therefore a space required to move the rotatable member 20 may only be required to be a rotation space of the rotatable member 20, and compared with the case where the sealing member 19 is moved by movement other than the rotation, it is possible to realize space saving.

By providing the sealing member 19 with the fold-back portion 19*d*, so that the bonding portion 22 can be inclination-peeled without using shearing peeling and thus can be unsealed with reliability.

Further, the engaged portion 19*b*, to be engaged with the rotatable member 20, for unsealing the sealing member 19 in an end side of the sealing member 19 with respect to a direction substantially perpendicular to the arrow F direction in which the plurality of openings 35*a* are arranged is provided, so that the sealing member 19 can be engaged and unsealed with reliability.

Further, by providing the frame with the fixing portion 18*c*, the flexible container 16 is supported by the frame during the unsealing, so that even a soft and deformable flexible container 16 becomes unsealable with reliability.

With respect to the discharge of the developer during the unsealing, as described above, the bonding portion 22 is moved along the line connecting the power application point portion 20*a* and the fixing portion 18*c* (in the order of (a) of FIG. 7, (b) of FIG. 7, (c) of FIG. 7 and (a) of FIG. 8). By this motion, the developer at the periphery of the openings 35*a* is moved, so that agglomeration of the developer can be broken.

(Positional Relation of Fixing Portion Associated with Unsealing)

As shown in FIG. 4, in order to peel off the first bonding portion 22*b* with reliability, the following positional relation is required between the first bonding portion 22*b* and the fixing portion 18*c*. During the unsealing, with respect to the fixing portion 18*c*, the rotatable member 20 pulls the sealing member 19 in the arrow D direction. At this time, with respect to the movement direction (arrow D direction) of the sealing member 19 by the rotatable member 20, the fixing portion 18*c* is provided upstream of the openings 35*a*. For that reason, a force is applied to the fixing portion 18*c* in the arrow H direction. Therefore, when the unsealing force is applied, the sealing member 19 is pulled in the arrow H direction and the arrow D direction between the fixing portion 18*c* and the rotatable member 20 to apply a force to the first bonding portion 20*a*, thus advancing the unsealing. Thus, when the fixing portion 18*c* is not provided upstream with respect to the movement direction (arrow D direction) of the sealing member 19, the entire flexible container 16 is pulled in the direction in which the sealing member 19 is pulled, so that the force cannot be applied to the first bonding portion 22*a* and thus the first bonding portion 22*a* cannot be unsealed.

In this way, the fixing portion 18*c* is provided upstream with respect to the movement direction (arrow D direction) of the sealing member 19, so that reliable unsealing becomes possible.

(Positional Relation of Second Bonding Portion)

With reference to FIG. 3 showing a state immediately before the first bonding portion 22*a* is unsealed, an arrangement in which the second bonding portion 22*b* can be more satisfactorily unsealed without being wound up around the rotatable member 20 will be described. First, an end portion of the first bonding portion 22*a* remote from the openings 35*a* is taken as a second point 22*e*. An end portion of the second bonding portion 22*b* remote from the openings 35*a* is taken as a third point 22*f*. A distance from the second point 22*e* to the third point 22*f* is taken as L1. A distance from the second point 22*e* to the power application point portion 20*a* is taken as L2. In this case, the distances L1 and L2 are required to satisfy the relationship of L1<L2.

This is because in the case where L1 is larger than L2, the second bonding portion 22*b* reaches the power application point portion 22*a* before the peeling of the second bonding portion 22*b* is ended, and thus the second bonding portion 22*b* is wound about the rotatable member 20. Therefore, the force cannot be applied so as to peel off the sealing member 19 from the second bonding portion 22*b*. For that reason, it becomes difficult to unseal the sealing member 19 from the flexible container 16.

As described above, the relationship between the distance L1 and L2 is made to satisfy: L1<L2, so that the sealing member 19 is satisfactorily unsealable without being wound about the rotatable member 20.

(Function of Connecting Portions Defining Openings)

A summary of the connecting portions 35*b*, defining the openings 35*a*, which perform a large function in the unsealing operation of the flexible container 16 will be described.

Part (a) of FIG. 11 is a schematic view of the discharging portion 35 when the peeling at the first bonding portion 22*a* to be first unsealed is ended to expose the openings 35*a*, and shows a state in which the peeling at the second bonding portion 22*b* is not ended. As described above, the discharging portion 35 includes the plurality of openings 35*a* shifted and disposed along the direction F perpendicular to the unsealing direction E in which the exposure of the openings 35*a* is advanced. For that reason, also the plurality of connecting portions 35*b* defining the plurality of openings 35*a* are disposed along the arrow F direction. As a result, the plurality of connecting portions 35*b* connect the first bonding portion 22*a* and the second bonding portion 22*b* with respect to the unsealing direction (arrow E direction) of the openings 35*a*. For that reason, at the time of the state of (a) of FIG. 8 in which the unsealing of the first bonding portion 22*a* is ended, the force for unsealing the second bonding portion 22*b* can be received by the fixed portion 16*d* via the connecting portions 35*b*, so that the force for peeling off the sealing member 19 from the flexible container 16 can be transferred. That is, the forces are applied to the second bonding portion 22*b* in the arrow D direction and the arrow E direction, so that also at the second bonding portion 22*b*, the sealing member 19 is peelable.

Thus, by the presence of the connecting portions 35*b* for connecting the first and second bonding portions 22*a* and 22*b* at the discharging portion 35, the developer accommodating container 30 including the developer accommodating container 26 accommodating the developer and including the rotatable member 20 can transmit the unsealing force of the rotatable member 20 until the second bonding portion 22*b* is unsealed, so that the discharging portion 35 can be unsealed with reliability.

(Effect of Thick Portion)

An effect of the reinforcing portion 35*c*1 will be described. First, as Comparison example, an abnormal phenomenon which occurs infrequently will be described. Thereafter, a constitution and an effect in this embodiment of the present invention will be described.

First, the abnormal phenomenon which occurs infrequently will be described. A state of unsealing of the flexible container 16 in partway in the case where the abnormal phenomenon occurs is shown in FIG. 12. Part (a) of FIG. 12 is a schematic view showing a state in which peeling of the second bonding portion 22*b* advances in partway, and a peeling direction is the same as that shown in FIG. 11.

Depending on a variation of a member for the flexible container 16, in the case where a thickness of the flexible container 16 in the neighborhood of the second bonding portion 22*b* and the openings 35*b* is thin or in the like case, rigidity against pulling at the periphery of the openings 35*a* is low. For that reason, during the peeling of the second bonding portion 22*b*, such a phenomenon that the flexible container 16 cannot withstand a peeling force for peeling the second bonding portion 22*b* and thus the openings 35*a* are deformed excessively to be elongated occurs in frequently. Part (a) of FIG. 12 shows the case where at an opening 35*a*1 as a part of the openings 35*a*, this phenomenon occurs and thus an elongated opening portion 35*a*2 is generated. A detailed schematic view of the opening 35*a*1 is shown in (b) of FIG. 12. A cross sectional view taken along a chain line indicated by arrows is shown in (c) of FIG. 12.

When the elongated opening portion 35*a*2 is generated in partway of the peeling of the second bonding portion 22*b*, as shown in (b) and (c) of FIG. 12, forces acting locally at the periphery of the second bonding portion 22*b* are directed in an arrow X direction and an arrow Y direction. In this case, the peeling is performed by generally known shearing peeling (approximately 0-degree peeling), and therefore a large force is required. As a result, a force necessary to peel the whole second bonding portion 22*b* becomes large or it is impossible to perform the peeling. That is, the case where the unsealing is stopped occurs infrequency.

As described above, in the case where the elongated opening portion 35*a*2 is generated at the opening 35*a*1 as the part of the openings 35*a*, different from a normal case, the abnormal phenomenon such that the peeling requires the large force occurs. Here, an important point is that the abnormal phenomenon occurs in the case where the openings 35*a* are excessively deformed.

In this embodiment, as shown in FIG. 11, the reinforcing portion 35*c*1 is provided at the edge of the opening 35*a*. As a result, it is possible to decrease a degree of the excessive deformation of the openings during the peeling of the bonding portion. That is, it is possible to suppress an increase in force necessary to perform the peeling by decreasing a degree of the elongation of the openings 35*a*. Accordingly, it is possible to suppress the occurrence of the abnormal phenomenon that the necessary peeling force is increased.

Embodiment 2

A constitution of a flexible container 16 in Embodiment 2 will be described with reference to (a) of FIG. 15. Part (a) of FIG. 15 is a schematic view corresponding to (c) of FIG. 11 showing the X-X cross section of the opening 35*a* in (b) of FIG. 11. As shown in (a) of FIG. 15, in this embodiment, a reinforcing portion 35*c*2 is provided along an edge of an opening 35*a* so as to be projected toward an inside of the flexible container 16. When a constitution in which the reinforcing portion 35*c*2 in this embodiment is projected toward the inside of the flexible container 16 is employed, the constitution is advantageous in that the reinforcing portion 35*c*2 can be easily formed by inserting a working tool 44 ((b) of FIG. 15) from an outside of the flexible container 16. Incidentally, on the other hand, in the case of a constitution in which the reinforcing portion 35*c*2 is projected to the outside of the flexible container 16, it can be said that this constitution is somewhat disadvantageous. Further, the reinforcing portion 35*c*2 is formed integrally with the flexible container 16 and is bent with respect to the connecting portion 35*b* at the periphery of the reinforcing portion 35*c*2.

Next, a method of formation of the reinforcing portion 35*c*2 will be specifically described with reference to (c) of FIG. 15. Part (b) of FIG. 15 is a schematic view showing during the processing of the formation of the reinforcing portion 35*c*2 shown in (a) of FIG. 15. As shown in (b) of FIG. 15, the working tool 44 for machining is operated with respect to an arrow direction in the figure, whereby the opening 35*a* is formed. At the same time of the generation of the opening 35*a*, the reinforcing portion 35*c*2 is generated at the edge of the opening 35*a*. A specific shape of the reinforcing portion 35*c*2 is similar to a shape obtained by burring (processing) frequently used in sheet metal processing.

Also in the constitution in this embodiment, similarly as in Embodiment 1, it is possible to decrease a degree of the excessive deformation of the openings during the peeling of the bonding portion. That is, it is possible to suppress an increase in force necessary to perform the peeling by decreasing a degree of the elongation of the openings 35*a*. Accordingly, it is possible to suppress the occurrence of the abnormal phenomenon that the necessary peeling force is increased.

Embodiment 3

A constitution of a flexible container 16 in Embodiment 3 will be described with reference to (a) of FIG. 16. Part (a) of FIG. 16 is a schematic view corresponding to (c) of FIG. 11 showing the X-X cross section of the opening 35*a* in (b) of FIG. 11. As shown in (a) of FIG. 16, in this embodiment, a reinforcing portion 35*c*3 is provided along an edge of an opening 35*a* so as to be projected toward an outside of the flexible container 16. When a constitution in which the reinforcing portion 35*c*3 in this embodiment is projected toward the outside of the flexible container 16 is employed, the constitution is advantageous in that the developer does not readily remain in the flexible container 16. Incidentally, on the other hand, in the case of a constitution in which the reinforcing portion 35*c*3 is projected to the inside of the flexible container 16, it can be said that the developer is liable to somewhat remain inside the flexible container 16. Further, the reinforcing portion 35*c*3 is formed integrally with the developer accommodating container 26 and is bent with respect to the flexible container 16 at the periphery of the reinforcing portion 35*c*3.

Next, a method of formation of the reinforcing portion 35*c*2 will be specifically described with reference to (c) of FIG. 16. Part (b) of FIG. 16 is a schematic view showing during the processing of the formation of the reinforcing portion 35*c*2 shown in (a) of FIG. 16. As shown in (b) of FIG. 16, the working tool 44 for machining is operated with respect to an arrow direction in the figure, whereby the opening 35*a* is formed. At the same time of the generation of the opening 35*a*, the reinforcing portion 35*c*3 is generated at the edge of the opening 35*a*. A specific shape of the reinforcing portion 35*c*3 is similar to a shape obtained by burring (processing) frequently used in sheet metal processing.

Also in the constitution in this embodiment, similarly as in Embodiment 1, it is possible to decrease a degree of the excessive deformation of the openings during the peeling of the bonding portion. That is, it is possible to suppress an increase in force necessary to perform the peeling by decreasing a degree of the elongation of the openings 35*a*. Accordingly, it is possible to suppress the occurrence of the abnormal phenomenon that the necessary peeling force is increased.

Embodiment 4

A constitution of a flexible container 16 in Embodiment 4 will be described with reference to FIG. 17. In the constitution in this embodiment, a reinforcing portion 35*d* has the same function as the reinforcing portion 35*c* in each of Embodiments 1, 2 and 3. FIG. 17 includes schematic views corresponding to those in FIG. 11. A detailed view of a portion of the openings 35*a* and the connecting portions 35*b* in (a) of FIG. 17 is shown in (b) of FIG. 17. Further, the X-X cross section of the opening 35*a* in (b) of FIG. 17 is shown in (d) of FIG. 17. As shown in (b) and (d) of FIG. 17, the reinforcing portion 35*d* is provided at the periphery of the opening 35*a*. Elastic modulus of the reinforcing portion 35*d* is higher than elastic modulus of a portion, of the flexible container 16, where the reinforcing portion 35*d* is not provided.

Further, in this embodiment, as a material for the flexible container 16, a material of which elastic modulus is higher after laser irradiation than before the laser irradiation is used. Specifically, e.g., as the material for the flexible container 16, a flexible material containing an ultraviolet (UV) curable agent is used. However, it can also be said that only the reinforcing portion 35*d* may only be required to contain the UV curable agent.

Next, a method of formation of the reinforcing portion 35*d* will be described. Part (c) of FIG. 17 is a schematic view showing a state during formation of the reinforcing portion 35*d* shown in (b) of FIG. 17, and (d) of FIG. 17 is a schematic view (similar to that of (d) of FIG. 17) showing a state after the formation of the reinforcing portion 35*d*. A periphery of the opening 35*a* formed by machining (in which the state of during machining is not illustrated) is irradiated with UV laser light 43, whereby the elastic modulus of the material for the flexible container 16 itself is changed to generate the reinforcing portion 35*d*.

Also in the constitution in this embodiment, it is possible to decrease a degree of the excessive deformation of the openings during the peeling of the bonding portion. That is, it is possible to suppress an increase in force necessary to perform the peeling by decreasing a degree of the elongation of the openings 35*a*. Accordingly, it is possible to suppress the occurrence of the abnormal phenomenon that the necessary peeling force is increased.

According to the constitution in each of Embodiments 1 to 4, when the sealing member 19 is peeled from the flexible container 16 at the periphery of the openings 35*a*, deformation of the openings 35*a* is suppressed, so that a load necessary for the peeling is suppressed.

Incidentally, in the constitutions in Embodiments 1 to 4, a dimension X1 which is the sum of the thickness of the flexible container 16 and the thickness of the reinforcing portion 35*c* (35*d*) is set at a value which is two times or more and five times or less of a dimension X0 of the thickness of the flexible container 16. For example, X0 is set at 100 μm, and X1 is set at 100 μm to 500 μm.

In the constitutions in Embodiments 1 to 4, the reinforcing portion 35*c* (35*d*) is integrally molded with the connecting portion 35*b* at the periphery of the opening 35*a*, but these constitutions are not limitative. That is, the reinforcing portion 35*c* (35*d*) may also be a separate member applied onto the connecting portion 35*b* at the periphery of the opening 35*a*. In this case, the reinforcing portion 35*c* (35*d*) may be molded with the same material as or with a different material from the material for the flexible container 16. Further, the constitutions in Embodiments 1 to 4 can be used in combination. For example, the UV curable agent may also be contained in the reinforcing portions in Embodiments 1 to 3 and then may be cured by UV irradiation.

REFERENCE EXAMPLE

For the purpose of improving an unsealing characteristic of the sealing member for sealing the openings of the deformable developer accommodating container, it would be considered that a flexible container 16 as shown in FIG. 18 is used. Part (a) of FIG. 18 is a perspective view showing the flexible container 16 before unsealing, and (b) of FIG. 18 is a perspective view of the flexible container 16 during the unsealing. In FIG. 18, a plurality of openings 35*a* for permitting discharge of the developer are arranged along a longitudinal direction of the flexible container 16. Further, before the unsealing of the openings 35*a*, the sealing member 19 is mounted to the flexible container 16 in a state in which the sealing member 19 seals the plurality of openings 35*a*, and when the openings 35*a* are unsealed, is pulled, so that the openings 35*a* are exposed. These openings are shifted and arranged in a direction perpendicular to the unsealing direction in which the exposure of the openings 35*a* advances. By employing such a constitution, a degree of large deformation of the openings 35*a* is decreased, so that the unsealing characteristic of the sealing member 19 for sealing the openings 35*a* of the flexible container 16.

However, in the above-described constitution, the following phenomenon occurs infrequently. That is, in the case where the thickness of the flexible container 16 is thin in the neighborhood of the openings 35 and the bonding portion between the openings 35*a* and the sealing member 19, resulting from the occurrence of thickness variation of the flexible container 16, rigidity against pulling at the periphery of the openings 35*a* is low, and therefore in a process in which the sealing member 19 is peeled from the openings 35*a*, a part of the openings 35*a* is excessively deformed. For that reason, a phenomenon such that a force for peeling the sealing member 19 from the openings 35*a* becomes large can occur. In this phenomenon, a part of the openings 35*a* is elongated and excessively deformed due to the low rigidity against the pulling at the periphery of the openings 35*a*, and thus the necessary peeling force is increased. Even in consideration of this phenomenon, it is understood that usefulness of the constitutions described in the embodiments according to the present invention is high.

According to the present invention, when the sealing member is peeled from the flexible container at the periphery of the openings, a degree of the deformation of the openings is decreased, so that the load necessary for the peeling is reduced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 003947/2013 filed Jan. 11, 2013 and 112297/2013 filed May 28, 2013, which are hereby incorporated by reference.

What is claimed is:

1. A developer accommodating container for accommodating developer, said developer accommodating container comprising:

a flexible container provided with a surface having an opening therein for permitting discharge of the developer;

a sealing member for sealing the opening in a state in which said sealing member is bonded to a periphery of the opening in said surface, wherein said sealing member is capable of exposing the opening by being removed in an unsealing direction; and a reinforcing portion provided at the periphery of the opening and on said surface, wherein a thickness of said flexible container and said reinforcing portion is thicker than that of a thickness of said flexible container in a direction perpendicular to said surface, and wherein said reinforcing portion is formed of the same material as a material for said flexible container.

2. A developer accommodating container according to claim 1, wherein said reinforcing portion is provided along an edge of the opening so as to be projected toward an inside of said flexible container and perpendicular to said surface.

3. A developer accommodating container according to claim 1, wherein said reinforcing portion is provided along an edge of the opening so as to be projected toward an outside of said flexible container and perpendicular to said surface.

4. A developer accommodating container according to claim 1, wherein a dimension obtained by adding a thickness of said flexible container and a thickness of said reinforcing portion is set to a value that is two times or more and five times or less of a dimension of the thickness of said flexible container.

5. A developer accommodating container according to claim 1, wherein said reinforcing portion is a separate member bonded to said flexible container at the periphery of the opening.

6. A developer accommodating container according to claim 1, wherein said reinforcing portion has an elastic modulus greater than an elastic modulus of said flexible container at a position where said reinforcing portion is not provided.

7. A developer accommodating container according to claim 1, wherein said reinforcing portion is formed integrally with said flexible container and is bent with respect to said flexible container at a periphery thereof.

8. A developer accommodating container according to claim 1, wherein said reinforcing portion contains an ultraviolet-curable material.

9. A process cartridge comprising:

an electrophotographic photosensitive drum; and a developer accommodating container according to claim 1.

10. An image forming apparatus comprising:

an image forming portion for forming an image; and a developer accommodating container according to claim 1.

11. A developing device comprising:

a developing carrying member carrying developer; and a developer accommodating container according to claim 1.

12. A developer accommodating container according to claim 1, wherein said reinforcing portion is next to the opening.

13. A developer accommodating container according to claim 1, further comprising a bonding portion between said sealing member and said flexible container, said bonding portion being located downstream of the opening with respect to the unsealing direction.

14. A developer accommodating container according to claim 1, wherein said reinforcing portion is surrounded by a bonding portion between said sealing member and said flexible container.

15. A developer accommodating container according to claim 1, wherein said flexible container is provided with a surface having a plurality of openings.

16. A developer accommodating container for accommodating developer, said developer accommodating container comprising:

a flexible container provided with a surface having an opening therein for permitting discharge of the developer;

a sealing member for sealing the opening in a state in which said sealing member is bonded to a periphery of the opening in said surface, wherein said sealing member is capable of exposing the opening by being removed in an unsealing direction; and a reinforcing portion provided at the periphery of the opening and on said surface, wherein a thickness of said flexible container and said reinforcing portion is thicker than that of a thickness of said flexible container in a direction perpendicular to said surface, and wherein said reinforcing portion is provided along an edge of the opening so as to be projected toward an inside of said flexible container and perpendicular to said surface.

17. A developer accommodating container for accommodating developer, said developer accommodating container comprising:

a flexible container provided with a surface having an opening therein for permitting discharge of the developer;

a sealing member for sealing the opening in a state in which said sealing member is bonded to a periphery of the opening in said surface, wherein said sealing member is capable of exposing the opening by being removed in an unsealing direction; and a reinforcing portion provided at the periphery of the opening and on said surface, wherein a thickness of said flexible container and said reinforcing portion is thicker than that of a thickness of said flexible container in a direction perpendicular to said surface, and wherein a dimension obtained by adding a thickness of said flexible container and a thickness of said reinforcing portion is set to a value that is two times or more and five times or less of a dimension of the thickness of said flexible container.

18. A developer accommodating container according to claim 17, wherein said reinforcing portion is provided along an edge of the opening so as to be projected toward an inside of said flexible container and perpendicular to said surface.

19. A developer accommodating container according to claim 17, wherein said reinforcing portion is provided along an edge of the opening so as to be projected toward an outside of said flexible container and perpendicular to said surface.

20. A developer accommodating container according to claim 17, wherein said reinforcing portion is a separate member bonded to said flexible container at a periphery of the opening.

21. A developer accommodating container according to claim 17, wherein said reinforcing portion has an elastic modulus greater than an elastic modulus of said flexible container at a position where said reinforcing portion is not provided.

22. A developer accommodating container according to claim 17, wherein said reinforcing portion is formed integrally with said flexible container and is bent with respect to said flexible container at a periphery thereof.

23. A developer accommodating container according to claim 17, wherein said reinforcing portion contains an ultraviolet-curable material.

24. A process cartridge comprising:

an electrophotographic photosensitive drum; and a developer accommodating container according to claim 17.

25. An image forming apparatus comprising:

an image forming portion for forming an image; and a developer accommodating container according to claim 17.

26. A developing device comprising:

a developing carrying member carrying developer; and a developer accommodating container according to claim 17.

27. A developer accommodating container according to claim 17, wherein said reinforcing portion is surrounded by a bonding portion between said sealing member and said flexible container.

28. A developer accommodating container for accommodating developer, said developer accommodating container comprising:

a flexible container provided with a surface having an opening therein for permitting discharge of the developer;

a sealing member for sealing the opening in a state in which said sealing member is bonded to a periphery of the opening in said surface, wherein said sealing member is capable of exposing the opening by being removed in an unsealing direction; and a reinforcing portion provided at the periphery of the opening and on said surface, wherein a thickness of said flexible container and said reinforcing portion is thicker than that of a thickness of said flexible container in a direction perpendicular to said surface, and wherein said reinforcing portion is formed integrally with said flexible container and is bent with respect to said flexible container at a periphery thereof.

* * * * *